US010927566B2

(12) United States Patent
Cagan

(10) Patent No.: US 10,927,566 B2
(45) **Date of Patent: *Feb. 23, 2021**

(54) TRANSPORTABLE DEVICE FOR PREVENTING A LOSS OF A MOVABLE OBJECT

(71) Applicant: Michael Nicolaus Cagan, San Antonio, TX (US)

(72) Inventor: Michael Nicolaus Cagan, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/658,895

(22) Filed: Oct. 21, 2019

(65) Prior Publication Data

US 2020/0048932 A1 Feb. 13, 2020

Related U.S. Application Data

(63) Continuation of application No. 15/472,687, filed on Mar. 29, 2017, now Pat. No. 10,450,775, which is a (Continued)

(30) Foreign Application Priority Data

Sep. 26, 2013 (DE) ..... 102013110669.2

(51) Int. Cl.
*E05B 45/00* (2006.01)
*E05B 17/22* (2006.01)
(Continued)

(52) U.S. Cl.
CPC ..... *E05B 45/005* (2013.01); *E05B 17/226* (2013.01); *E05B 45/04* (2013.01);
(Continued)

(58) Field of Classification Search
CPC ..... E05B 17/002; E05B 17/226; E05B 2045/067; E05B 2045/0695;
(Continued)

(56) References Cited

U.S. PATENT DOCUMENTS 3,824,540 A 7/1974 Smith
4,776,188 A 10/1988 Dalaba et al.
(Continued)

FOREIGN PATENT DOCUMENTS

DE 10 2012 201021 A1 7/2013
WO WO 03/002837 A1 1/2003

OTHER PUBLICATIONS

PCT Search Report, dated Feb. 26, 2015.
IPRP, Mar. 29, 2016.

*Primary Examiner* — Quan-Zhen Wang
*Assistant Examiner* — Rajsheed O Black-Childress
(74) *Attorney, Agent, or Firm* — Dority & Manning, P.A.

(57) ABSTRACT

The invention relates to a transportable device for preventing a loss of a movable object, comprising a protective housing (2) for protecting the device (1), an electronic alarm device (35), which is arranged in the protective housing (2) and has an anti-theft alarm function, and fastening means (11) for detachably fastening the device (1) to the movable object, wherein the fastening means (11) comprise at least one wrap-around element (12; 46; 52; 59; 68) for wrapping around at least one part of the movable object and wherein the wrap-around elements (12; 46; 52; 59; 68) can be fixed by means of locking elements (19, 20, 21; 49, 50, 51; 55, 57, 58; 61, 63, 64, 65; 71, 72, 73), which are arranged in the protective housing (2), wherein the locking elements (19, 20, 21; 49, 50, 51; 55, 57, 58; 61, 63, 64, 65; 71, 72, 73) can be selectively opened and closed by means of a lock device (13) rigidly connected to the protective housing (2), and wherein additionally the protective housing (2) can be selectively opened and rigidly connected to the protective housing (2), and wherein additionally the protective housing (2) can be selectively opened and closed by means of said
(Continued)

lock device (13) and access to at least one chamber (18, 33) in the protective housing (2) is thereby enabled.

20 Claims, 13 Drawing Sheets

Related U.S. Application Data continuation of application No. 15/025,051, filed as application No. PCT/IB2014/001935 on Sep. 26, 2014, now abandoned.

(51) Int. Cl.

| | |
|---|---|
| ***E05B 45/04*** | (2006.01) |
| ***E05B 47/00*** | (2006.01) |
| ***E05B 67/24*** | (2006.01) |
| ***E05B 67/38*** | (2006.01) |
| ***E05B 73/00*** | (2006.01) |
| ***G08B 13/22*** | (2006.01) |
| ***E05B 45/06*** | (2006.01) |
| ***E05B 67/00*** | (2006.01) |
| ***E05B 17/00*** | (2006.01) |
| ***G07C 9/00*** | (2020.01) |
| ***E05B 67/02*** | (2006.01) |

(52) U.S. Cl.

CPC ..... *E05B 47/0001* (2013.01); *E05B 67/24* (2013.01); *E05B 67/38* (2013.01); *E05B 73/0005* (2013.01); *E05B 73/0011* (2013.01); *G08B 13/22* (2013.01); *E05B 17/002* (2013.01); *E05B 67/003* (2013.01); *E05B 67/006* (2013.01); *E05B 67/02* (2013.01); *E05B 2045/067* (2013.01); *E05B 2045/0695* (2013.01); *E05B 2047/0095* (2013.01); *E05B 2047/0096* (2013.01); *E05B 2067/386* (2013.01); *G07C 9/00309* (2013.01); *G07C 2009/00539* (2013.01)

(58) Field of Classification Search

CPC ..... E05B 2047/0095; E05B 2047/0096; E05B 2067/386; E05B 45/005; E05B 45/04; E05B 47/0001; E05B 67/24; E05B 67/38; E05B 73/0005; E05B 73/0011; G07C 2009/00539; G07C 9/00309; G08B 13/22

See application file for complete search history.

(56) References Cited

U.S. PATENT DOCUMENTS

| | | | | |
|---|---|---|---|---|
| 5,889,463 | A * | 3/1999 | Judd | B60R 25/1001 340/425.5 |
| 7,543,467 | B2 | 6/2009 | Sheehan | |
| 7,640,079 | B2 * | 12/2009 | Nickerson | A01G 25/16 700/284 |
| 7,921,682 | B1 | 4/2011 | Chang | |
| 8,482,411 | B1 | 7/2013 | Brown | |
| 8,680,996 | B2 | 3/2014 | Foti | |
| 2005/0231365 | A1 | 10/2005 | Tester | |
| 2007/0152835 | A1 | 7/2007 | Marsilio et al. | |
| 2009/0320537 | A1 | 12/2009 | Alexander | |
| 2011/0260867 | A1 * | 10/2011 | McCracken | E05B 45/005 340/568.4 |
| 2013/0036781 | A1 | 2/2013 | Hartmann | |
| 2014/0250954 | A1 * | 9/2014 | Buzhardt | E05B 39/04 70/20 |

* cited by examiner

TRANSPORTABLE DEVICE FOR PREVENTING A LOSS OF A MOVABLE OBJECT

RELATED APPLICATIONS

The present application is a Continuation Application of U.S. application Ser. No. 15/472,687, filed Mar. 29, 2017, which is a Continuation Application of U.S. application Ser. No. 15/025,051, filed Mar. 25, 2016, which is a Section 371 of PCT/IB2014/001935, filed Sep. 26, 2014, which claims priority to German Application No. 10 2013 110 669.2, filed Sep. 26, 2013.

FIELD OF THE INVENTION

The invention relates to a transportable device for preventing the loss of a movable object.

BACKGROUND

Such devices are known, for example, for protecting two-wheeled vehicles. Thereby, a free end of a wrap-around element provided on the lock, for example a chain, may be guided around a frame tube and between spokes of a wheel, in order to then fix it to the housing of the lock by means of locking elements.

Furthermore, devices with which an openable and closable container is temporarily fixed to an object by means of a wrap-around element that can be locked to the container are known. For example, such devices are known for the leisure sector; an example of this is a beach safe, which can be attached to an umbrella or a lounge chair.

However, there is a need for the optimization of such devices, particularly in terms of flexibility, breadth of use, and security.

SUMMARY OF THE INVENTION

As such, a task of this invention is to improve a transportable device for preventing the loss of a movable object. Additional objects and advantages of the invention will be set forth in part in the following description, or may be obvious from the description, or may be learned through practice of the invention.

With a device of the type mentioned above, the task is solved by the characteristics of device described and claimed herein.

A protective housing in this case is understood to be a shell of the device that is essentially closed for the protection of the device, and is so durable that it cannot be broken by force without tools. An electronic alarm device in this case is the entirety of the means that are provided for an anti-theft alarm function. The term "theft alarm function" hereby refers to the triggering of an alarm that is triggered by an attempted theft. Additional functions can be integrated into the electronic alarm device. Fastening elements for detachably fastening the device to the movable object are fastening elements that are detachable without being destroyed.

Additionally, wrap-around elements are elements that are formed in an elongated shape, which are suitable for wrapping around an object. In addition, locking elements are selectively openable or closable elements that fix the wrap-around elements in their closed state to the protective housing in such a manner that the wrap-around elements form a closed loop that cannot be opened or substantially lengthened without opening the locking elements. In particular, the locking elements and the lock device acting on it are not arranged externally on the protective housing; rather, they are arranged in the protective housing, such they are not accessible without damaging the protective housing, except through the opening of the lock device. This measure increases the security function of the device to a considerable extent.

By means of such a wrap-around element, the device in accordance with the invention can be quickly, securely and easily attached to almost any object to be protected. It is also possible that the wrap-around element is to be wrapped around not only a part of the object to be protected, but at the same time also a fixed object, such as a street lamp or a fence, such that the object to be protected is protected against loss not only by an alarm, but also mechanically. Examples of objects that are protectable with the device in accordance with the invention include the following: two-wheeled vehicles, skis, boats, surfboards, bags, suitcases, helmets, garden furniture and much more.

In particular, the invention offers the advantage that a device is provided that combines the three following function in particular: 1) wrap-around element lockable to the protective housing, 2) alarm function, and 3) access to the interior of the protective housing. A particular advantage arises from the fact that the lock device assumes a dual function—on the one hand, so that the locking elements can be opened and closed, yet on the other hand for the protective housing, in order to gain access to at least one chamber of the protective housing. Through this arrangement, it is both the case that weight is saved and the handling of the device is facilitated. Through the fixed arrangement of the lock device in the protective housing, a high level of security is also ensured.

Generally, a lock device is a device that, on the one hand, enables authorized persons to selectively open or close the protective housing and to selectively open or close the locking elements—and on the other hand to deny this to unauthorized persons. In doing so, the identification of an authorized person can take place by means of a key, as will be discussed further below.

According to an advantageous additional form of the invention, it is provided that the locking elements are at least partially arranged in at least one first chamber of the protective housing, and that the electronic alarm device is at least partially arranged in at least one second chamber of the protective housing. Thereby, a "chamber" is understood to be an essentially closed space in the protective housing. In practice, the first chamber cannot be completely closed, because openings for the locking elements necessarily must be provided, such that the penetration of dirt or moisture cannot be completely prevented. The provision of a second chamber for the electronic alarm device can significantly improve its protection against dirt and moisture, such that the operational reliability of the device is significantly increased.

According to an expedient additional form of the invention, with a closed protective housing, the second chamber is protected against the penetration of spray water, preferably against the penetration of water jets, and more preferably against the penetration of water when submerging the device in water. In this manner, the device can be operated safely, even under adverse environmental conditions. In addition, the device being put out of service by potential thieves using liquids can be prevented.

According to an advantageous additional form of the invention, the at least one chamber formed for access, which is preferably formed by the specified first and/or second chamber, is formed for the temporary accommodation of objects that are insertable and removable. These include, for example, bank cards, bank notes, wallets, identity documents, jewelry, communications devices such as a portable telephone (for example, a smartphone), etc. Thus, the at least one chamber in the protective housing preferably serves as a storage container for valuable or important items, which can be inserted into the device in accordance with the invention, which can be fixed with the assistance of the wrap-around element to a stationary object, for example at a durable railing or a lantern.

If access to the second chamber is enabled by the opening of the protective housing, the electronic alarm device in the second chamber can also be reached. It is then possible, for example, to exchange an electronic component, to replace a power supply (battery) or to change or update software of software-operated elements of the electronic alarm device (for example, a processor of a mobile device).

With a device with fastening elements, a lockable protective housing and an electronic alarm device, the specified concept of two or more chambers separated from each other within a protective housing and their different functionalities must also be regarded as an independent aspect of the invention.

According to an expedient additional form of the invention, the lock device comprises a mechanical lock, which features a mechanical closing element. This arrangement is durable, weatherproof and failure resistant.

According to a related advantageous additional form, the mechanical lock is actuated with a mechanical key. With the aid of the mechanical key, the device may be fastened in a simple manner to the object to be protected, and protected against unauthorized access. In this case, the activation or deactivation, as the case may be, of the anti-theft alarm function takes place, for example, by means of a switch inside the protective housing, which is accessible only with an open protective housing. If the mechanical lock is arranged in the first chamber, this prevents dirt or moisture from penetrating the second chamber through an opening of the mechanical lock provided for the mechanical key, which could cause damage to or the malfunctioning of the electronic alarm device arranged thereon.

According to a preferred additional form related to the mechanical key, this is rotatable in the mechanical lock in such a manner that the opening of the protective housing, on the one hand, and the opening of the locking elements, on the other hand, can be achieved by turning the key by different rotation angles. Thus, the aforementioned dual function of the lock device can be realized in an extremely simple manner, with the assistance of the specified mechanical key.

According to an alternative or additional advantageous form of the invention, the lock device comprises an electronically activated element, wherein the electronic actuation takes place in particular by means of a mobile telephone, by radio, in particular by means of Bluetooth or a data cable. Thereby, an electronically activated element comprises an actuating device (in particular a motor) of the lock device, which can be actuated with an electronic key (for example, a radio signal). From outside of the device with an electronic key to be actuated, through an electrical or an electronic system that is accommodated in the protective housing, this controls the electronically activated element (for example, a motor), which then acts on a mechanical locking component of the lock device. For example, the motor thereby acts on a mechanical shaft of the lock device, in order to rotate closing cams and locking cams. It is particularly advantageous if the lock is actuated by means of a radio transmitter, for example by means of a corresponding transmission function of a smartphone, such that it can be operated remotely.

According to an advantageous additional form of the invention, the interlocking device can be interlocked by means of at least one locking cam rotatably connectable to the lock device and/or unlocked by a spring. In this case, a locking cam is a rounded projection on a shaft. The locking cam can be actuated mechanically by means of the specified mechanical key and/or electro-mechanically by means of the specified electronic key and the electronically activated element, and results in a simple mechanical structure of the device.

According to an advantageous additional form of the invention, an electronic lock is provided; this can be used to activate or deactivate the electronic alarm device. In this manner, this results in a simple structure for activating or deactivating, as the case may be, the electronic alarm device, since the electronic lock may emit electrical signals to control the electronic alarm device, without electromechanical components being necessary for this. If the electronic lock is a mobile telephone-based lock or a radio remote-controlled lock, in particular a Bluetooth-based lock, it can also be operated remotely. Preferably, the electronic lock is arranged in the second chamber, and is thus optimally protected from damage of any kind.

Preferably, the specified electronic lock also serves to actuate the specified electrically activated element, which is capable of acting on a mechanical locking component of the lock device. While, in accordance with the statements above, the electronic lock is preferably arranged in the second chamber, the mechanical component (for example, the specified motor) is arranged in the first chamber in order to act on the mechanical locking component.

As described above for a mechanical key, the mechanical closing component—for example, a shaft on which a closing cam is arranged for the locking element and a locking cam is arranged for the interlocking element—may be, based on commands to the electronic lock, which in turn actuates the electronically activated element, rotated by certain rotation angles in order to release or lock the locking element for the wrap-around element or the interlocking element for the protective housing, as the case may be.

It is advantageous if, with its dual function—thus, on the one hand, selectively opening and closing the locking elements and, on the other hand, selectively opening and closing the interlocking elements, the lock device is actuated both with the assistance of a mechanical key and with the assistance of an electronic key, which acts on an electronically activated element (such as a motor) of the lock device. If, for example, a power supply for the electronic lock in the protective housing is no longer able to provide sufficient energy, the lock device can still be opened and closed with the mechanical key.

With a device with fastening elements, a lockable protective housing and an electronic alarm device, the specified concept of two principles acting in different ways on the open and closed mechanism (on the one hand, a mechanical key, on the other hand, an electronically activated element) must also be regarded as an independent aspect of the invention.

According to an expedient additional form of the invention, the protective housing features at least two housing parts, which are fixed to each other by means of an interlocking device actuated through the lock device, in such a manner that the first chamber and the second chamber are protected against unauthorized access. In this manner, unauthorized access to the first and second chambers and to the locking elements and/or to the electronic alarm device can be effectively prevented.

According to an expedient additional form of the invention, the protective housing essentially consists of a metal, a hard plastic and/or a composite material. In this manner, the protective housing is formed to be light-weight but nevertheless resistant to environmental influences and/or unauthorized access. Preferably, it is also formed to be waterproof.

According to an advantageous additional form of the invention, in the protective housing, a partition wall assembly is provided for separating the first and second chambers. In this manner, a separation of the first chamber and the second chamber can be easily achieved.

According to an expedient additional form of the invention, the electronic alarm device features an acoustic alarm transmitter for outputting acoustic alarm messages. In this manner, the user of the device and/or persons that happen to be passing by can be alerted to a potential theft in a larger radius.

According to an advantageous additional form of the invention, the electronic alarm device features a visual display device, which is formed to display operating states, in particular the operating states of "anti-theft alarm function activated," "anti-theft alarm function deactivated," "alarm triggered," "low battery." In this manner, the operation of the device can be facilitated.

According to an expedient additional form of the invention, the electronic alarm device features a direction-finding transmitter. A direction-finding transmitter is such a transmitter that transmits an electromagnetic signal, which is received with a direction-finding receiver, wherein the direction-finding receiver is able to detect the direction from which the signal is coming. In this manner, it is possible to track down the object to be protected if its position is not known. The direction-finding transmitter can be automatically activated when an alarm is triggered or if an accident occurs. The direction-finding transmitter is preferably also formed to receive signals (direction-finding antenna).

According to an advantageous additional form of the invention, the electronic alarm device features a particularly water-protected power supply connection and/or data connection. The power supply connection enables the supply of power to the device. For example, an energy storage device of the device can be easily charged in such a manner. The data connection enables the transfer of data to the device. For example, a new program version can be installed on the electronic alarm device. The power supply connection and/or data connection may be formed, for example, according to the USB standard. Thereby, the corresponding USB port is preferably accessible only with an open protective housing, since it is then protected against damage from the outside (for example, by gluing it with gum).

Generally, it is advantageous if there are no connection openings on the closed protective housing accessible from the outside, or other openings essential for the operation of the device (except for possibly a keyhole for a mechanical key). With a device with fastening elements, a lockable protective housing and an electronic alarm device, this concept of non-accessibility must also be regarded as an independent aspect of the invention.

According to an expedient additional form of the invention, the electronic alarm device features a first electrical energy storage device for powering the electronic alarm device in normal mode, and preferably also a second electrical energy storage device for powering the electronic alarm device in emergency mode. In this manner, the operation of the device can be maintained without interruption, at least in a limited function, if the first energy store device is exhausted.

According to an advantageous additional form of the invention, the wrap-around element is a dimensionally stable wrap-around element, preferably a bracket, in particular a steel bracket. Dimensionally stable wrap-around elements are highly durable and resistant to attempts to open the wrap-around elements by force, such that an unauthorized attempt to remove the device from the object to be protected is made significantly more difficult.

According to an expedient additional form of the invention, the wrap-around element is at least a partially deformable wrap-around element. Deformable wrap-around elements are flexible in use, since their shape can be adjusted to the surface of the object to be protected.

According to an advantageous additional form of the invention, the at least partially deformable wrap-around element is at least partially elastically deformable, and preferably comprises a cable, in particular a steel cable. Such wrap-around elements are durable, lightweight and inexpensive.

According to an expedient additional form of the invention, the at least partially deformable wrap-around element is at least partially flexibly deformable, and preferably comprises a chain, in particular a roller chain, a link chain or a chain belt. Such wrap-around elements can be fixed particularly securely to the protective housing by means of corresponding locking elements.

According to an advantageous additional form of the invention, the locking elements comprise rolling-up elements for rolling up the deformable wrap-around element. It is thereby possible to roll up the deformable wrap-around elements if they are not needed. If the rolling-up element is spring-loaded, the deformable wrap-around element can be automatically rolled up. If, preferably, the rolling-up element is selectively releasable or blockable by means of a blocking device connected to the lock device in respect of a rotation, the deformable wrap-around element can be locked with selectable length, such that loops with varying lengths can be provided, such that the scope of application of the device is further increased.

According to an expedient additional form of the invention, the locking elements feature at least one latching element for engagement in an undercut, a teeth arrangement or in an opening of the wrap-around element. This results in a form-fitting and thus secure locking of the wrap-around element. If the wrap-around elements can be closed through at least one locking cam or thread arrangement rotatably connectable to the lock device, and/or can be closed by means of a spring, this results in a simple structure and a simple operability of the device.

According to an advantageous additional form of the invention, the locking elements feature at least one clamping device for clamping the wrap-around elements. In this manner, a frictional locking of the wrap-around elements arises, which has the advantage that the wrap-around elements can be locked with a freely selectable length, such that the length of the loops can be adjusted continuously. If the clamping device can be selectively closed or opened by means of a thread rotatably connected to the lock device, this results in a simple structure and simple operability of the device.

According to an expedient additional form of the invention, the electronic alarm device features a positioning device, in particular a satellite-based and/or a mobile telephone-based positioning device, for determining the position of the device. In this manner, the position of the device can be detected after a theft. For this purpose, the device is able to transmit the current position to a receiver through suitable means. However, the positioning device may also be used to reliably detect an attempted theft. As such, it is expedient to configure the alarm device to activate an alarm upon a change in position.

According to an advantageous additional form of the invention, the electronic alarm device features a motion sensor, in particular a tilt sensor and/or an acceleration sensor, for activating an alarm. A "tilt sensor" is understood to be a sensor that detects a change in position. Furthermore, an "acceleration sensor" is understood to be a sensor that detects a change in movement. Such sensors provide reliable indications that could indicate an attempted theft.

According to an expedient additional form of the invention, the electronic alarm device features a mobile telephone device for sending alarm messages; in particular, as a text message, a picture message, a voice message and/or a video message. In doing so, the user or a security service can be alerted at almost any distance. It is thereby expedient if the alarm message includes the position of the device.

A related advantageous additional form of the invention provides that the electronic alarm device is formed for two-way communication with an external communications device, such as an external mobile telephone. It is advantageous if the electronic alarm device is able to accommodate a SIM card. Over the two-way communication, a message may be sent from the external communications device to the device in accordance with the invention, for example, an activation or deactivation of the alarm function over the specified electronic lock, or a closing of the mechanical lock with the assistance of the electronic lock and the electronically activated element.

A deactivation of an alarm triggered, for example, by a change in position of the device, which was forwarded to the external communications unit, can then be undertaken by sending a corresponding deactivation message to the device. This can prevent, for example, an acoustic alarm signal from being emitted over a long period time and not being able to be switched off. By means of the specified arrangement, the operator, on the one hand, is informed by the alarm that possibly indicates a theft, but is in the position to himself switch off such alarm on the device. Alternatively, only the operator receives the display of an alarm signal on its external communications device (or another connected device), without ever triggering a perceptible alarm signal on the device in accordance with the invention.

With a device with fastening elements, a lockable protective housing and an electronic alarm device, the specified concept of two-way communication must also be regarded as an independent aspect of the invention.

According to an advantageous additional form of the invention, between the wrap-around elements and/or the locking elements, on the one hand, and the electronic alarm device, on the other hand, no coupling is provided, such that the destruction of the wrap-around elements and/or the locking elements necessarily leads to the triggering of an alarm on the part of the electronic alarm device, even if the anti-theft alarm function is activated. This means that the wrap-around elements essentially serve to deter thieves. The durable design of the protective housing also supports this purpose. In this arrangement, the electronic alarm device does not respond—at least not primarily—to the use of force/destruction, but does respond, for example, through the sending of a signal as a result of a change in location of the device, for example when the secured object is carried away together with the device in accordance with the invention. For this purpose, a motion sensor and/or a GPS transmitter (positioning sensor) can be provided in the electronic alarm device. With a correspondingly advantageous additional form, the electronic alarm device is accordingly formed in such a manner that it triggers an alarm upon the movement of the transportable device as a whole.

A motion sensor may also register vibrations upon the forceful breakup of the device, and trigger an alarm. However, with this embodiment of the invention, this scenario is not the primary intended.

With a device with fastening elements, a lockable protective housing and an electronic alarm device, the specified concept of the separation of the alarm triggering and the destruction of the fastening elements and/or the protective housing must also be regarded as an independent aspect of the invention.

According to an advantageous additional form of the invention, the electronic alarm device features an emergency mode, with which, upon an emergency, an emergency message is automatically sent by means of the mobile telephone device, in particular as a text message, a picture message, a voice message and/or a video message. The emergency mode serves less to protect an object, but rather to protect the user of the device. For example, the emergency mode can be switched on when the user of the device uses a motor vehicle. If an accident thereafter occurs, an emergency message is sent to the appropriate emergency service. It is thereby expedient if the emergency message includes the position of the device. Preferably, the anti-theft alarm function is switched off in emergency mode, in order to not trigger any false alarms, which could be triggered, for example, by the movement of the motor vehicle.

According to an expedient additional form of the invention, with emergency mode, the occurrence of the emergency can be input manually with an emergency button. By pressing the emergency button, an automatic emergency message can then be sent to a preset appropriate emergency number, which for the user is faster and easier than, for example, establishing a connection to an emergency number manually with a mobile telephone. Alternatively or additionally, it may be provided that the emergency message is sent automatically without pressing an emergency button.

According to an advantageous additional form of the invention, in emergency mode, the occurrence of an emergency can be detected automatically by means of the positioning device. For this purpose, criteria for recognizing an emergency can be stored beforehand. Thereby, the alarm device for detecting the occurrence of an emergency at a position constant for a predetermined time may be formed. This is based on the idea that, after an accident (for example, an avalanche in which the user is buried), it is generally the case that the position of the user and thus the device no longer changes.

According to an expedient additional form of the invention, in emergency mode, the occurrence of an emergency can be detected automatically by means of the motion sensor. For this purpose, criteria for recognizing an emergency can be stored beforehand. Thereby, the alarm device for detecting the occurrence of an emergency at an acceleration exceeding a predetermined upper limit may be formed. This is based on the realization that, during accidents, extremely high accelerations frequently occur.

According to an advantageous additional form of the invention, the electronic alarm device features a camera.

Upon attempted thefts and/or emergencies, the camera is able to enable the automatic preservation of evidence. Expediently, the alarm device for automatically activating the camera upon the occurrence of an emergency is formed for this purpose. Alternatively or additionally, it may be provided that the camera is activated manually. The camera may also be called on for normal use, for example, for taking souvenir photos during hiking, skiing or cycling tours.

According to a more preferred embodiment, with an open protective housing, the electronic alarm device can be removed from it and can then be used as a stand-alone device. In particular, the electronic alarm device can be used to locate the device, to send alerts and messages and/or as a camera.

With a device with fastening elements, a lockable protective housing and an electronic alarm device, the specified stand-alone concept must also be regarded as an independent aspect of the invention.

Furthermore, the invention concerns a set with a transportable device for preventing the loss of a movable object and a vehicle mount for detachably mounting the device on a vehicle, wherein the transportable device is formed in accordance with the invention. The vehicle mount is particularly advantageous if the device is operated in emergency mode.

According to an advantageous additional form of the invention, the vehicle mount features a clamping device or a suction foot for securing the vehicle mount on the vehicle. In this manner, the vehicle mount can be easily and securely fastened on almost any vehicle.

According to an expedient additional form of the invention, a power supply cable and/or data cable is provided. Thereby, on the one hand, power can be transferred from the electrical system of the motor vehicle to the device and, on the other hand, a data exchange between the vehicle and the device can also be enabled. For example, the position data of the positioning device of the device can be adjusted with the position data of a positioning device of the vehicle.

Thereby, the advantageous embodiments and additional forms of the invention described above and/or reproduced in the sub-claims may be—except, for example in cases of clear dependencies or incompatible alternatives—used individually or in any combination with each other.

BRIEF DESCRIPTION OF THE DRAWINGS

The invention and its advantageous embodiments and additional forms and their advantages are explained in more detail below with reference to drawings. The following are shown, in each case in a schematic outline sketch.

DETAILED DESCRIPTION

Figure 1:
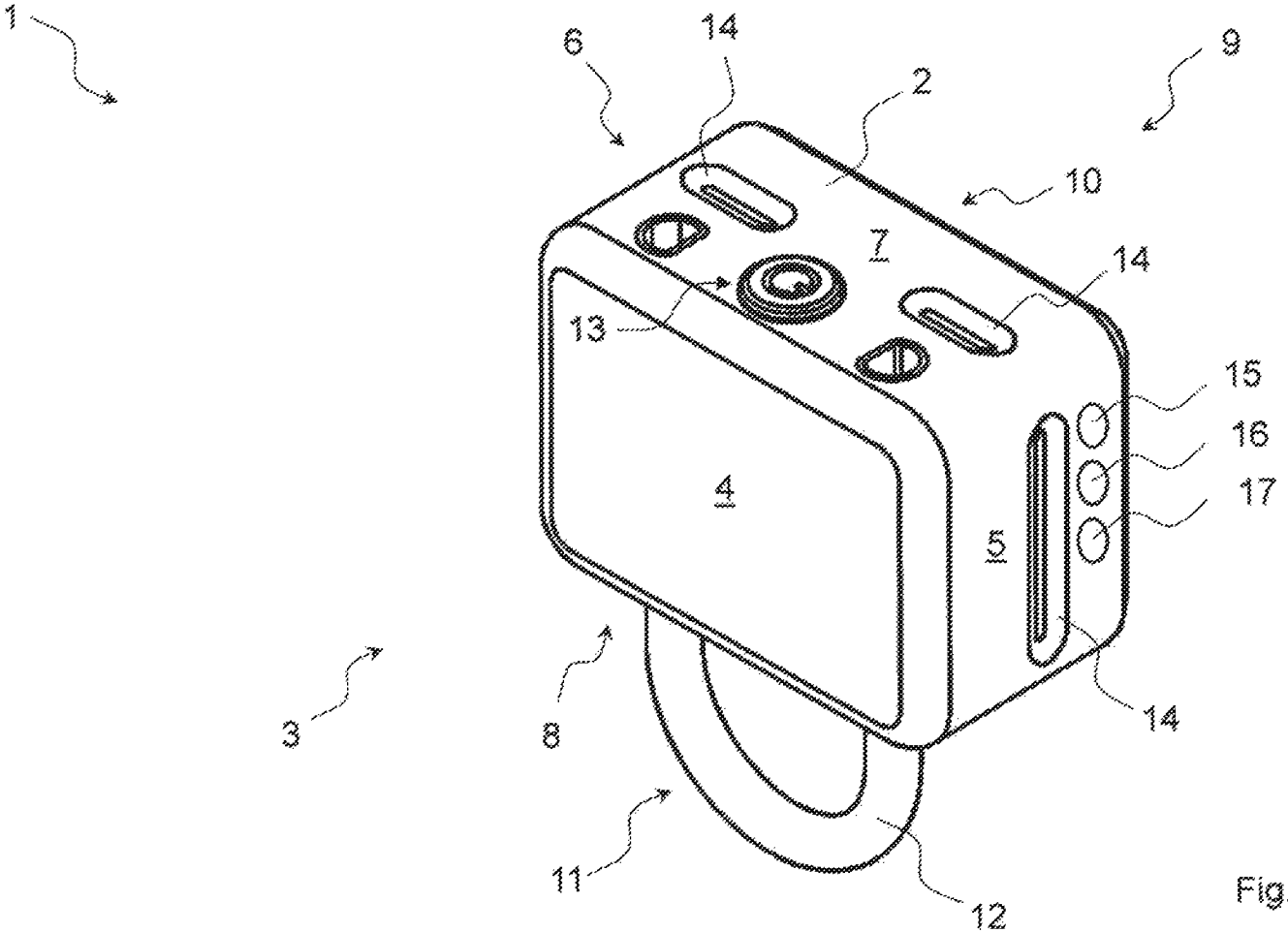
FIG. 1 a first embodiment of a transportable device in accordance with the invention, in a schematic three-dimensional view, FIG. 2 the transportable device of FIG. 1 is a schematic sectional top view, wherein the locking elements are open, FIG. 3 the transportable device of FIGS. 1 and 2 in a schematic sectional top view, wherein the locking elements are closed, FIG. 4 the transportable device of FIGS. 1 to 3 in a schematic sectional front view, wherein the interlocking device is open, FIG. 5 the transportable device of FIGS. 1 to 4 in a schematic sectional front view, wherein the interlocking device is closed, FIG. 6 the transportable device of FIGS. 1 to 5 in a schematic sectional front view, FIG. 7 the transportable device of FIGS. 1 to 6 in a schematic sectional top view, FIG. 8 a second embodiment of a transportable device in accordance with the invention, in a schematic three-dimensional view, FIG. 9 the transportable device of FIG. 8 in a schematic sectional side view, wherein the locking elements are open, FIG. 10 the transportable device of FIGS. 8 and 9 in a schematic sectional side view, wherein the locking elements are closed, FIG. 11 a third embodiment of a transportable device in accordance with the invention, in a schematic three-dimensional view, FIG. 12 the transportable device of FIG. 9 in a schematic sectional top view, wherein the locking elements are closed, FIG. 13 a fourth embodiment of a transportable device in accordance with the invention, in a schematic three-dimensional view, FIG. 14 the transportable device of FIG. 13 in a schematic sectional top view, wherein the locking elements are open, FIG. 15 the transportable device of FIGS. 13 and 14 in a schematic sectional top view, wherein the locking elements are closed, FIG. 16 a fifth embodiment of a transportable device in accordance with the invention, in a schematic three-dimensional view, FIG. 17 the transportable device of FIG. 16 in a schematic sectional side view, wherein the locking elements are open, FIG. 18 the transportable device of FIGS. 16 and 17 in a schematic sectional side view, wherein the locking elements are closed, and FIG. 19 an embodiment of a set in accordance with the invention, in a schematic three-dimensional view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following figures, parts corresponding to each other are provided with the same reference signs. In doing so, only those components of a device for preventing the loss of a movable object that are necessary for understanding the invention are provided with reference signs. It is self-evident that the device in accordance with the invention may include other components and assemblies.

FIG. 1 shows a first embodiment of a transportable device 1 in accordance with the invention with an electronic alarm device with an anti-theft alarm function to prevent the loss of a movable object, in a schematic three-dimensional view. This comprises a protective housing 2 formed as a shell of the device 1, which, for the protection of the device, is essentially closed. The protective housing 2 features a bowl-shaped first housing part 3, which features a bottom 4, a first sidewall 5, a second side wall 6, a front wall 7 and a rear wall 8. Furthermore, the protective housing 2 features a second housing part 9, which is formed as a cover 10.

Expediently, at least one housing part 3, 9 comprises a metal, a hard plastic and/or a composite material. In this manner, the protective housing 2 is formed to be lightweight but nevertheless resistant to environmental influences and/or unauthorized access. As a whole, the protective housing 2 is designed in such a manner that it can be opened only with a key (see below) or by force.

From the protective housing 2, a fastening element 11 extends for the detachable fastening of the device 1 on the movable object. Fastening elements 11 for detachably fastening the device to the movable object are fastening elements 11 that are detachable without being destroyed. Thereby, the fastening element 11 is formed as a wrap-around element 12, which is understood to be an element 11 formed in an elongated shape, which is suitable for wrapping around an object or a part of an object.

In the first embodiment, the wrap-around element 12 is a dimensionally stable wrap-around element 12, preferably a bracket 12, in particular a steel bracket 12. Dimensionally stable wrap-around elements 12 are highly durable and resistant to attempts to open the wrap-around elements 12 by force, such that an unauthorized attempt to remove the device from the object to be protected is made significantly more difficult.

Furthermore, the device features a lock device 13, which is rigidly connected to the protective housing 2. In the embodiments in accordance with the figures, the lock device 13 features a mechanical lock 13' that can be operated by means of a mechanical key (not shown). The lock device 13 serves the purpose of, on the one hand, fixing and releasing the wrap-around elements 12 to the protective housing 2 and, on the other hand, opening and closing the protective housing 2, as will be explained below in more detail respectively.

In addition, mounting sections 14 formed outside of the protective housing 2 are provided as recesses 14 for mounting the device 1 in a mount. In addition, a first light-emitting diode 15, a second light-emitting diode 16 and a third light-emitting diode 17 are provided outside of the protective housing 2.

Figure 2:
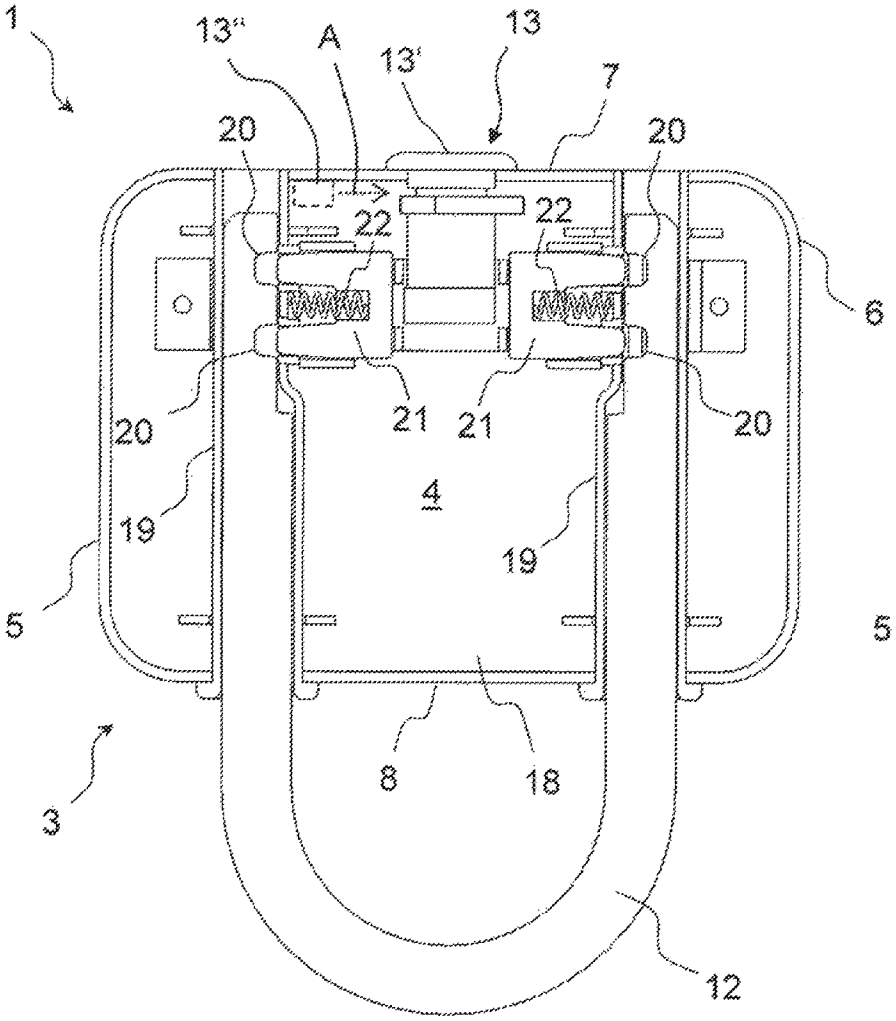

FIG. 2 shows the device of FIG. 1 in a schematic sectional top view. The protective housing 2 features a first chamber 18, in which openable or closable locking elements 19, 20, 21 are arranged selectively by means of the lock device 13, through which the wrap-around element 12 can be fixed to the protective housing 2. Thereby, a "chamber" 18 is understood to be an essentially closed space in the protective housing 2. Locking elements 19, 20, 21 are selectively openable or closable elements 19, 20, 21 that fix the wrap-around elements 12 in their closed state to the protective housing 2 in such a manner that the wrap-around elements 12 form a closed loop that cannot be opened or substantially lengthened without opening the locking elements 19, 20, 21. In FIG. 2, the locking elements 19, 20, 21 are open.

Each of the locking elements 19, 20, 21 includes a guide tube 19 for each end of the bracket 12 and an undercut 20 at each end of the bracket, wherein a latching element 21 is allocated to each undercut 20. Furthermore, a spring 22 is allocated to each latching element. Thereby, the springs 22 are arranged in such a manner that the latching elements 21 are, in the open state of the locking elements 19, 20, 21, disengaged from the undercuts 20, such that the bracket 12 can be pulled out of the guide tubes 19 in order to, for example, loop the bracket 12 around the frame of a two-wheeled vehicle.

Figure 3:
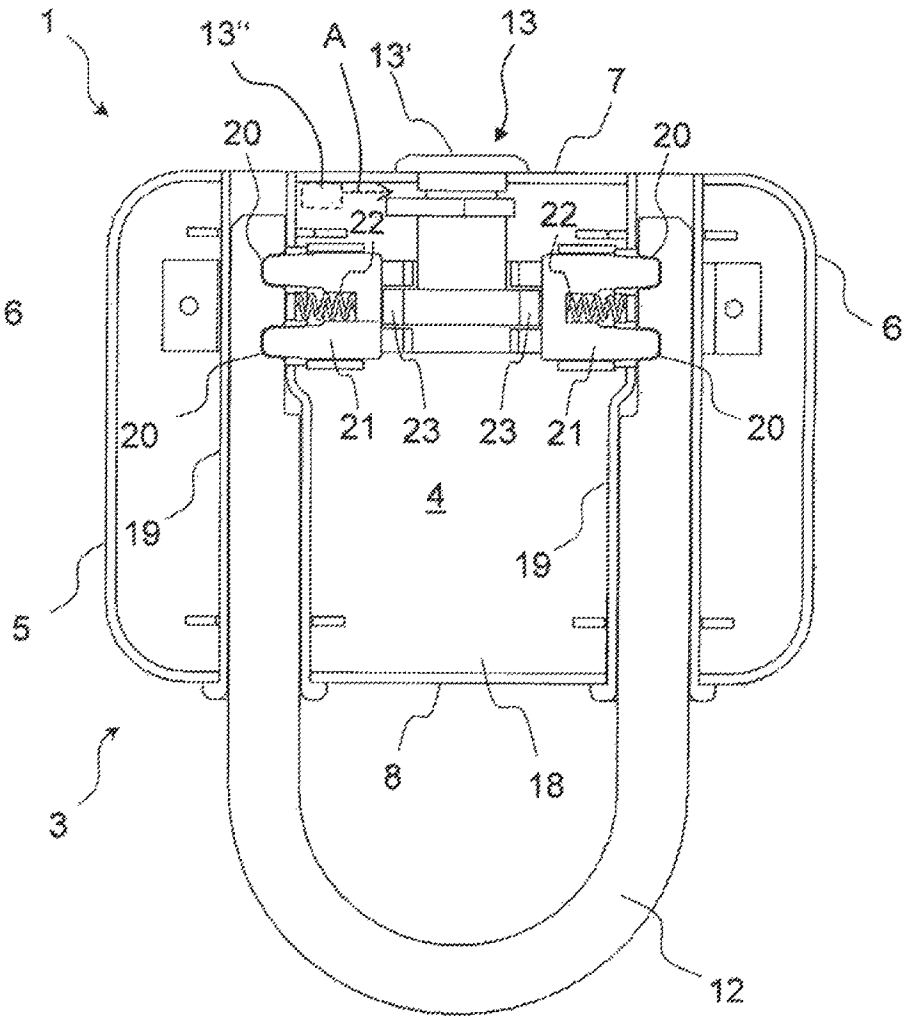

FIG. 3 shows the device of FIGS. 1 and 2 in a schematic sectional top view, wherein the locking elements 19, 20, 21 are closed. This is effected by means of two closing cams 23 rotatable with the mechanical lock 13', which bring the latching elements 21 into engagement with the undercuts 20 against the force of the springs 22, such that the bracket 12 is fixed in the guide tubes 19. This results in a form-fitting and thus secure locking of the wrap-around element 12. If the wrap-around elements 12 can be closed through at least one locking cam 23 or thread arrangement rotatably connectable to the lock device 13, and/or can be closed by means of a spring 22, this results in a simple structure of the device 1 along with a simple operability the device 1.

By means of such a wrap-around element 12, the device 1 in accordance with the invention can be quickly, securely and easily attached to almost any object to be protected. It is also possible that the wrap-around element 12 is to be wrapped around not only a part of the object to be protected, but at the same time also a fixed object, such as a bicycle rack or a fence, such that the object to be protected is protected against loss not only by an alarm, but also mechanically. Examples of objects that are protectable with the device 1 in accordance with the invention include the following: two-wheeled vehicles, skis, boats, surfboards, bags, suitcases, helmets, garden furniture and much more.

With the device 1 in accordance with the invention, no tool for fixing the device 1 to the object to be protected is required. In addition, the device 1 in accordance with the invention can be used very flexibly, since a section suitable for screwing together, for example, need not be present on the object to be protected, and/or since an adapter suitable for screwing together need not be attached to the object to be protected.

Figure 4:
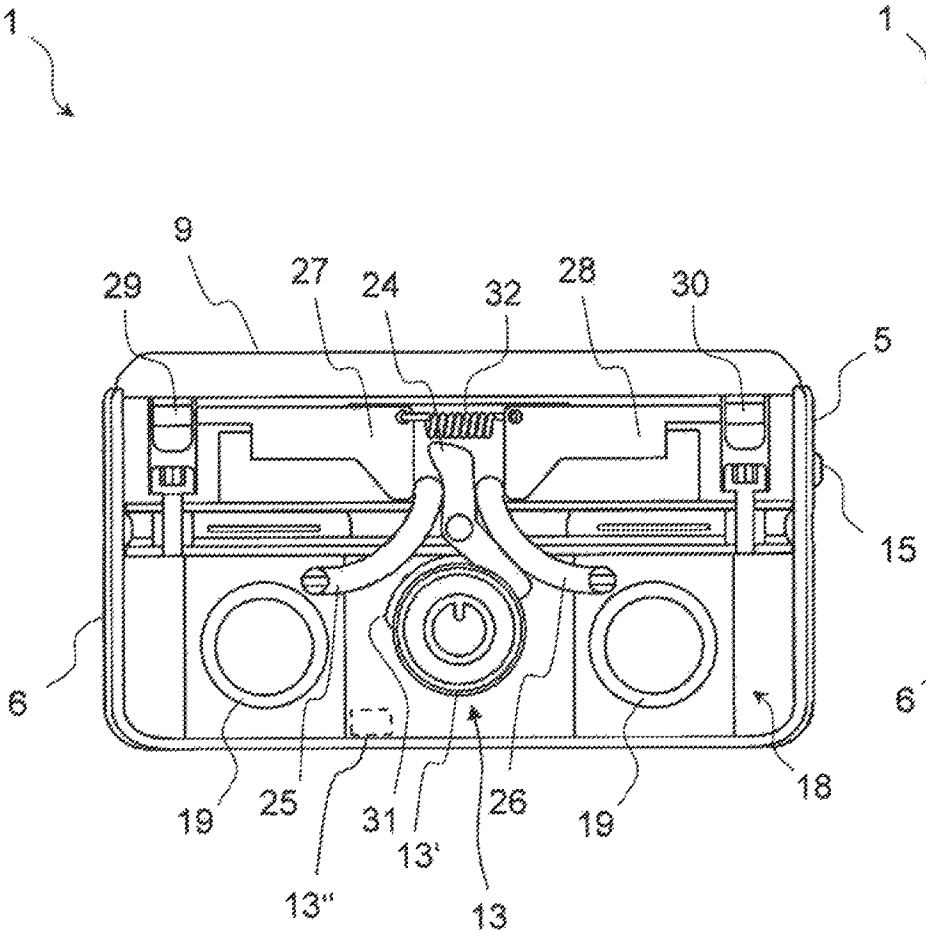

FIG. 4 shows the device 1 of FIGS. 1 to 3 in a schematic sectional front view. The embodiment illustrates, by way of an example, how the lock device 13 is formed not only for selectively opening and closing the locking elements 19, 20, 21, but also for selectively opening and closing the protective housing 2. In order to be able to fix the first housing part 3 and the second housing part 9 to each other, an interlocking element 24, 25, 26, 27, 28, 29, 30 actuated through the lock device 13 is provided; this is open in FIG. 4. The interlocking element 24, 25, 26, 27, 28, 29, 30 comprises a first lever 24, a second lever 25, a third lever 26, a first latch 27, a second latch 28, which are fixed to the first housing part 3, along with a first opening 29 and a second opening 30, which are formed on the second housing part 9. The first lever 24 features two arms and is deflected through a locking cam 31, which can be rotated by means of the mechanical lock 13'. Thereby, the locking cam 31 and the aforementioned closing cam 23 are both arranged at a lock shaft of the mechanical lock 13'. With a deflection of the first lever 24, its first arm brings about a deflection of the second lever 25, which then pushes the first latch 27 out of the open position shown in FIG. 4, and is thereby brought into engagement with the opening 29. Furthermore, a deflection of the first lever 24 leads to the fact that its second arm brings about a deflection of the third lever 26, which then pushes the second latch 28 out of the open position shown in FIG. 4, and is thereby brought into engagement with the opening 30. Insofar as the locking cam 31 is in the open position shown in FIG. 4, the unlocking spring 32 ensures that the first latch 27 is disengaged from the first opening 29 and that the second latch 28 is disengaged from the second opening 30, such that the first housing part 3 and the second housing part 9 can be separated.

Figure 5:
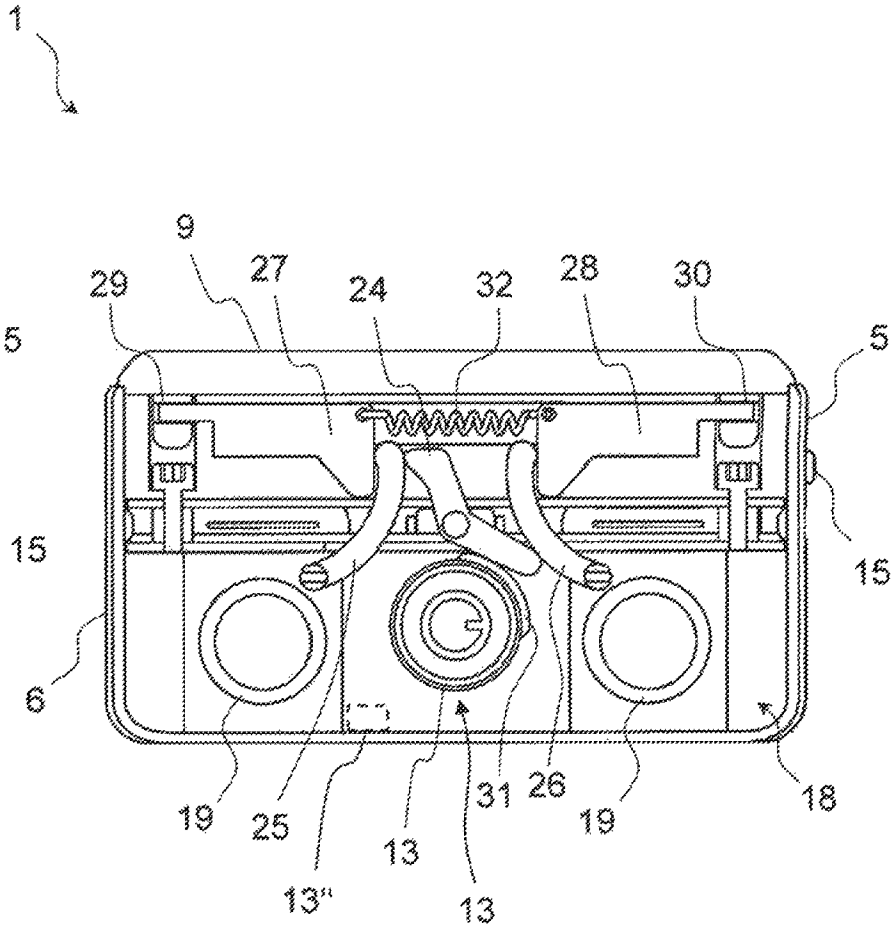

FIG. 5 shows the device of FIGS. 1 to 4 in a schematic sectional front view, wherein the latch 27 is engaged with the opening 29 and the latch 28 in engaged with the opening 30, such that the interlocking device 24, 25, 26, 27, 28, 29, 30 is closed, and thereby the first housing part 3 and the second housing part 9 are fixed to each other.

It is clear from the foregoing that, upon a rotation of a mechanical key into the mechanical lock 13' by 90° to the right from the position shown in FIG. 4 into the position shown in FIG. 5, the protective housing 2 can be closed. The movement of the key in the opposite direction opens the lock 13' and allows access to the interior of the protective housing 2. Similarly, a rotation of the key by 90° causes the locking elements 19, 20, 21 to be open or closed. It is thereby expedient if the interlocking elements 24, 25, 26, 27, 28, 29, 30 and the locking elements 19, 20, 21 are not opened or closed with the same movement. An advantageous opening process provides, for example, that, starting from an arbitrarily defined 0° position of the key, a 90° rotation releases the locking elements or interlocking elements and a further rotation by 90° releases the interlocking elements or the locking elements, as the case may be, while the elements that are not released are accordingly closed. According to one of several possible alternatives, through a rotation of the key from a 0° position by 90° in one direction, the locking elements are released, and, upon a rotation from the 0° position by 90° in the other direction, the interlocking elements are released, while the elements that are not released are accordingly closed.

Figure 6:
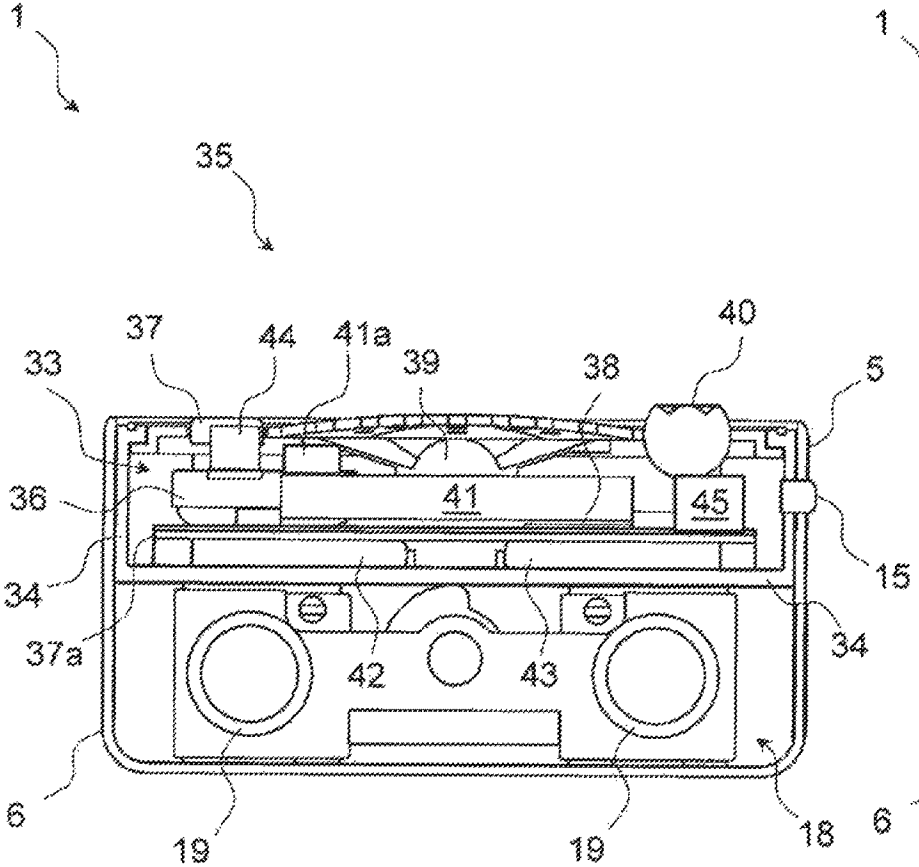

FIG. 6 shows the transportable device of FIGS. 1 to 5 in a schematic sectional front view, wherein the cover 10 is removed.

Figure 7:
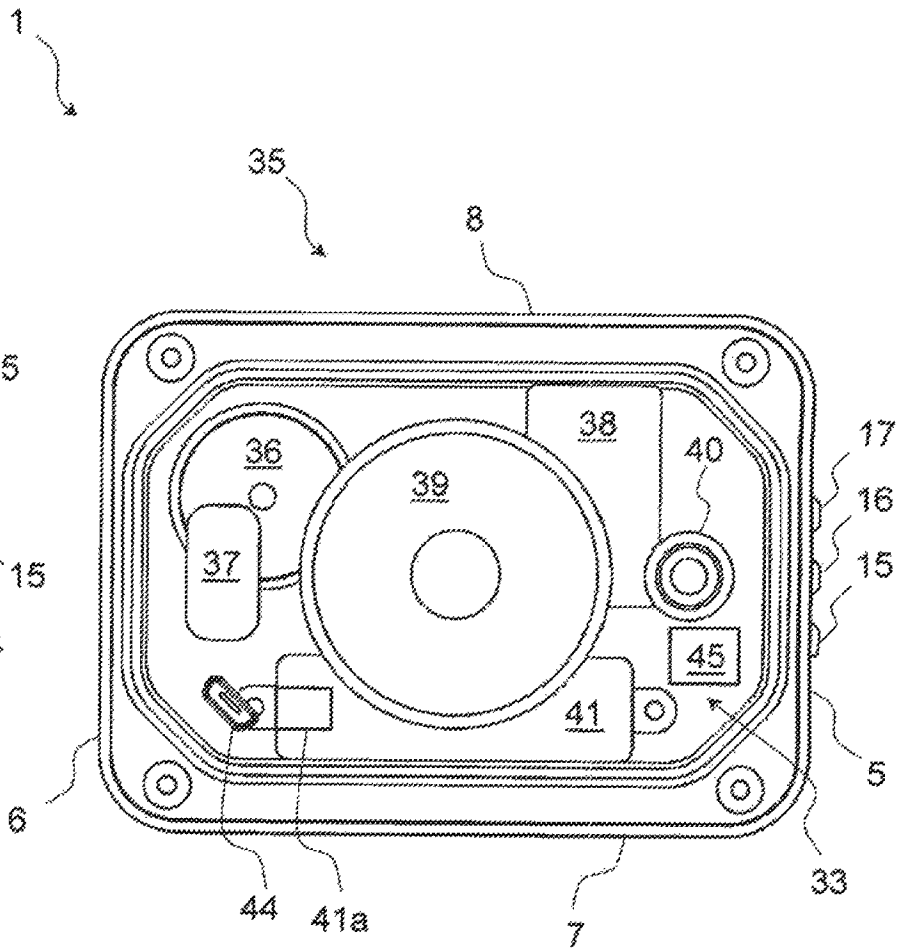

FIG. 7 shows the device of FIG. 6 in a schematic sectional top view, wherein the cover 10 is removed.

The protective housing 2 features a second chamber 33, which is separated by a partition wall assembly 34 of the first chamber 18. In this manner, a simple separation of the first chamber 18 and the second chamber 33 arises. If, with an open protective housing 2, the partition wall assembly 34 is removable, both chambers 18, 33 and the elements of the device 1 arranged therein are easily accessible with an open protective housing 2. The electronic alarm device 35 is arranged in the second chamber 33, which features an anti-theft alarm function. Thereby, an electronic alarm device 35 is the entirety of the means 35 that are provided for an anti-theft alarm function. Thereby, the term "anti-theft alarm function" refers to a triggering of an alarm, which is triggered by an attempted theft.

With the embodiments shown in the figures, there is no direct connection between the wrap-around elements 12, the locking elements 19, 20, 21, the interlocking elements 24, 25, 26, 27, 28, 29, 30 on the one hand, and the alarm device 35 on the other hand. This means that a breaking of, for example, the wrap-around elements 12 does not immediately trigger an alarm. Such is triggered, for example, if a positioning device determines that the device 1 is carried away from a location.

In the first embodiment, the electronic alarm device 35 comprises the LEDs 15, 16, 17, a tilt sensor 36, an emergency button 37, a positioning device 37*a*, a mobile telephone device 38, an acoustic alarm transmitter 39, a camera 40, an acceleration sensor 41, a direction-finding transmitter 41*a*, a first energy storage device 42, a second energy storage device 43 and a power supply connection and/or data connection 44. Moreover, an electronic lock 45 is provided, which is described below.

It is advantageously provided that the locking elements 19, 20, 21 are at least partially arranged in at least one first chamber 18 of the protective housing 2, and that the electronic alarm device 35 is at least partially arranged in at least one second chamber 33 of the protective housing 2. In practice, the first chamber 18 cannot be completely closed, because openings for the locking elements 19, 20, 21 necessarily must be provided, such that the penetration of dirt or moisture cannot be completely prevented. The provision of a second chamber 33 for the electronic alarm device 35 can significantly improve its protection against dirt and moisture, such that the operational reliability of the device 1 is significantly increased.

Expediently, with a closed protective housing 2, the second chamber 33 is protected against the penetration of spray water, preferably against the penetration of water jets, and more preferably against the penetration of water when submerging the device 1 in water. In this manner, the device 1 can be operated safely, even under adverse environmental conditions. In addition, the device 1 being put out of service by potential thieves using liquids can be prevented.

In one of the two chambers 18, 33, a (not shown explicitly) space is preferably provided, in which temporary objects, in particular valuables (jewelry, money, credit cards, smart phone, etc.), can be inserted and stored. These are securely stored by the interlocking elements 24, 25, 26, 27, 28, 29, 30, which seal the protective housing 2. Alternatively or additionally, for storing such objects in one of the two chambers 18, 33, one or more additional chambers (not shown) may be provided in the protective housing 2, which are likewise accessible only upon the opening of the protective housing 2.

Advantageously, the electronic alarm device 35 features a motion sensor, in particular a tilt sensor 36 and/or an acceleration sensor 41, for activating an alarm. A "tilt sensor" 36 is understood to be a sensor that detects a change in position. Furthermore, an "acceleration sensor" 41 is understood to be a sensor that detects a change in movement. Such sensors 36, 41 provide reliable indications that could indicate an attempted theft.

In accordance with the invention, the lock device 13 is provided both for preventing the unauthorized opening of the protective housing 2 and for preventing the unauthorized opening of the locking elements 19, 20, 21. Within the meaning of the invention, a lock device 13 is a device that, on the one hand, enables authorized person to selectively open or close the protective housing 2 and selectively open or close the locking elements 19, 20, 21 and, on the other hand, to deny this to unauthorized persons. Thereby, the identification of an authorized person can be effected by means of a key, which may be a mechanical key (such as the mechanical key 13' specified above and further described below) or an electronic key (in this regard, see also below).

Preferably, the lock device 13 comprises a mechanical lock 13'. Thereby, a mechanical lock 13' is an actuating device of the lock device 13, which can be actuated with a mechanical key. If the mechanical lock 13' is arranged in the first chamber 18, this prevents dirt or moisture from penetrating the second chamber 33 through an opening of the mechanical lock 13' provided for the mechanical key, which could cause damage to or the malfunctioning of the electronic alarm device 35 arranged thereon.

In accordance with the invention, the mechanical lock 13' is provided for the prevention of an unauthorized opening of the protective housing 2 and for the prevention of an unauthorized opening of the locking elements 19, 20, 21. In this manner, the device 1 can be fastened by means of a mechanical key to the object to be protected, and protected against unauthorized access. In this case, the activation or deactivation, as the case may be, of the anti-theft alarm function takes place, for example, by means of a switch (not shown) inside the protective housing 2, which is accessible only with an open protective housing 2.

Alternatively or in addition to a purely mechanically operating lock 13', the lock device 13 comprises an electronic lock 45 (in the present case in FIGS. 2-5, only indicated schematically), which can be formed in particular as a mobile telephone-based lock or as a radio remote-controlled lock, in particular a Bluetooth-based lock or a data cable-based lock. Thereby, an electronic lock 45 is an actuating device of the lock device 13, which can be actuated with an electronic key. An electronic lock 45 may be formed to control an electrical or electronic element, which, through an electronically activated element 13", actuates a mechanical locking component of the lock device 13, as shown schematically in FIGS. 2 and 3 by the arrow A. The electronically activated element 13" is formed, for example, as an electric motor. For purposes of clarity, the corresponding transmission for engaging the mechanical closing component, in particular a shaft of the lock device 13, is not shown.

The electronic lock 45 (preferably actuated by means of remote control, for example by means of a smartphone) is preferably arranged in the second chamber 33, and the electronically activated element 13" (for example, a motor) is arranged in the first chamber 18. For this purpose, from the electric lock 45 into the second chamber 33, signal lines (not shown) lead to the electronically activated element 13" in the first chamber 18, wherein, to this end, in the wall separating the chambers 18, 33, corresponding contact plugs (preferably waterproof), for example, are provided (not shown).

The effect of an electronically activated element 13" on the mechanical closing component of the lock device 13 may be the same as that upon the rotation of the mechanical key at a certain angle in a purely mechanical lock 13' (see descriptions above). For example, triggered by the electronic lock 45, the shaft on which the closing cam 23 and the locking cam 31 are arranged can be correspondingly rotated by the electrically activated element 13" around its longitudinal axis, in order to realize the various open and closed states.

If the electronic lock 45—as described above—is arranged in the second chamber 33, it is automatically protected against both unauthorized access and against dirt and moisture.

Advantageously, the electronic lock 45 is provided to activate or deactivate, as the case may be, the electronic alarm device 35. This results in a simple structure for activating or deactivating, as the case may be, the electronic alarm device 35, since the electronic lock 45 may emit electrical signals to control the electronic alarm device 35, without electromechanical components being necessary for this. If the electronic lock 45 is a mobile telephone-based lock or a radio remote-controlled lock, in particular a Bluetooth-based lock, it can also be operated remotely.

The electronic lock 45 is advantageously also available if the lock device 13 is only actuated through a mechanical key; thus, no electrically actuated element 13" is present.

Expediently, the two protective housing parts 3, 9 are fixed to each other by means of the interlocking device 24, 25, 26, 27, 28, 29, 30 actuated through the lock device 13, in such a manner that the first chamber 18 and second chamber 33 are protected against unauthorized access. In this manner, unauthorized access to the locking elements 19, 20, 21 and/or the electronic alarm device 35 can be effectively prevented.

Expediently, the electronic alarm device 35 features a visual display device 15, 16, 17, which is formed to display operating states, in particular the operating states of "anti-theft alarm function activated," "anti-theft alarm function deactivated," "alarm triggered," "low battery." In this manner, the operation of the device 1 can be facilitated. In the embodiment, a first LED 15 is provided for displaying the operating state of "anti-theft alarm function activated," wherein an extinguished first LED 15 displays the operating state of "anti-theft alarm function deactivated." Furthermore, a second LED 16 is provided for displaying the operating state of "alarm triggered" and a third LED 17 is provided for displaying the operating state of "low battery."

Advantageously, the electronic alarm device 35 features an acoustic alarm transmitter 39 for outputting acoustic alarm messages. In this manner, the user of the device 1 and/or persons that happen to be passing by can be alerted to a potential theft in a larger radius. As can be seen, the alarm transmitter 39 is arranged in the second chamber 33, such that it serves as a resonance chamber in a closed state. This arrangement also has the advantage that the alarm transmitter 39 in the second chamber 33 is protected from damage.

Preferably, the electronic alarm device 35 features a direction-finding transmitter 41*a*. A direction-finding transmitter 41 is a transmitter that transmits an electromagnetic signal, which is received with a direction-finding receiver, wherein the direction-finding receiver is able to detect the direction from which the signal is coming. In this manner, it is possible to track down the object to be protected if its position is not known. The direction-finding transmitter 41 can be automatically activated when an alarm is triggered.

Expediently, the electronic alarm device 35 features a particularly water-protected power supply connection and/or data connection 44. The power supply connection 44 enables the supply of power to the device 1. For example, an energy storage device 42, 43 of the device 1 can be easily charged in such a manner. The data connection 44 enables the transfer of data to the device 1. For example, a new program version can be installed on the electronic alarm device 35. The power supply connection and/or data connection 44 may be formed, for example, according to the USB standard. As can be seen in FIG. 7, the USB and/or data connection 44 is accessible only with an open protective housing 2.

Preferably, the electronic alarm device 35 features a first electrical energy storage device 42 for powering the electronic alarm device 35 in normal mode and a second electrical energy storage device 43 for powering the electronic alarm device 35 in emergency mode. In this manner, the operation of the device 1 can be maintained without interruption, at least in a limited function, if the first energy storage device 42 is exhausted.

Expediently, the electronic alarm device 35 features a positioning device 37*a*, in particular a satellite-based and/or a mobile telephone-based positioning device, for determining the position of the device 1. In this manner, the position of the device 1 can be detected after a theft. For this purpose, the device 1 is able to transmit the current position to the receiver through suitable means. However, the positioning device 37*a* may also be used to reliably detect an attempted theft. As such, it is expedient to configure the alarm device 35 to activate an alarm upon a change in position.

Preferably, the electronic alarm device 35 features a mobile telephone device 38 for sending alarm messages; in particular, as a text message, a picture message, a voice message and/or a video message. In doing so, the user or a security service can be alerted at almost any distance. It is thereby expedient if the alarm message includes the position of the device 1.

The electronic alarm device 35 more preferably also features a receiver, such that it is formed for two-way communication with an external communications device. This arrangement enables, for example, the switching off of a triggered alarm on the device 1.

Advantageously, the electronic alarm device 35 features an emergency mode, with which, upon an emergency, an emergency message is automatically sent by means of the mobile telephone device 38, in particular as a text message, a picture message, a voice message and/or a video message. The emergency mode serves less to protect an object, but rather to protect the user of the device 1. For example, the emergency mode can be switched on when the user of the device 1 uses a motor vehicle. If an accident thereafter occurs, an emergency message is sent to the appropriate emergency service. It is thereby expedient if the emergency message includes the position of the device 1. Preferably, the anti-theft alarm function is switched off in emergency mode, in order to not trigger any false alarms, which could be triggered, for example, by the movement of the motor vehicle.

Expediently, with emergency mode, the occurrence of an emergency can be input manually with an emergency button 37. By pressing the emergency button 37, an automatic emergency message can then be sent to a preset appropriate emergency number, which for the user is faster and easier than, for example, establishing a connection to an emergency number manually with a mobile telephone.

Preferably, in emergency mode, the occurrence of an emergency can be detected automatically by means of the positioning device 37*a*. For this purpose, criteria for recognizing an emergency can be stored beforehand. Thereby, the alarm device 35 for detecting the occurrence of an emergency at a position constant for a predetermined time may be formed. This is based on the idea that, after an accident (for example, an avalanche in which the user is buried), it is generally the case that the position of the user and thus the device 1 no longer changes.

Advantageously, in emergency mode, the occurrence of an emergency can be detected automatically by means of the motion sensor 36, 41. For this purpose, criteria for recognizing an emergency can be stored beforehand. Thereby, the alarm device 35 for detecting the occurrence of an emergency at an acceleration exceeding a predetermined upper limit may be formed. This is based on the realization that, during accidents, extremely high accelerations frequently occur.

Expediently, the electronic alarm device 35 features a camera 40. In particular, when there is an emergency, the camera 40 is able to enable the automatic preservation of evidence. Expediently, the alarm device for automatically activating the camera 40 upon the occurrence of an emergency is formed for this purpose.

Alternatively or additionally, the camera 40 may also be used for the conventional taking of souvenir and documentation photos, for example during outdoor tours.

In the embodiment, it is provided that, with an activated anti-theft alarm function, the second housing part 9, thus the cover 10, is interlocked to the first housing part 3 by means of the interlocking device 24, 25, 26, 27, 28, 29, 30. However, in order to protect the camera 40, it is arranged under the cover 10. Therefore, it is provided in the embodiment that the cover 10 is removed in emergency mode in order to be able to use the camera.

The camera 40 could also be arranged in such a manner that it can also be used with a closed protective housing 2. Then, as part of an anti-theft alarm function, the camera 40 could also enable the automatic preservation of evidence upon an attempted theft.

More preferably and representing an independent aspect of the invention, with an open protective housing 2, the electronic alarm device 35 is removable from the second chamber 33. Thereby, the electronic alarm device 35 is preferably formed as a stand-alone device, and can be used, for example, as a camera and/or an emergency call device and/or an anti-theft alarm (for example, in the glove compartment of a car).

Figure 8:
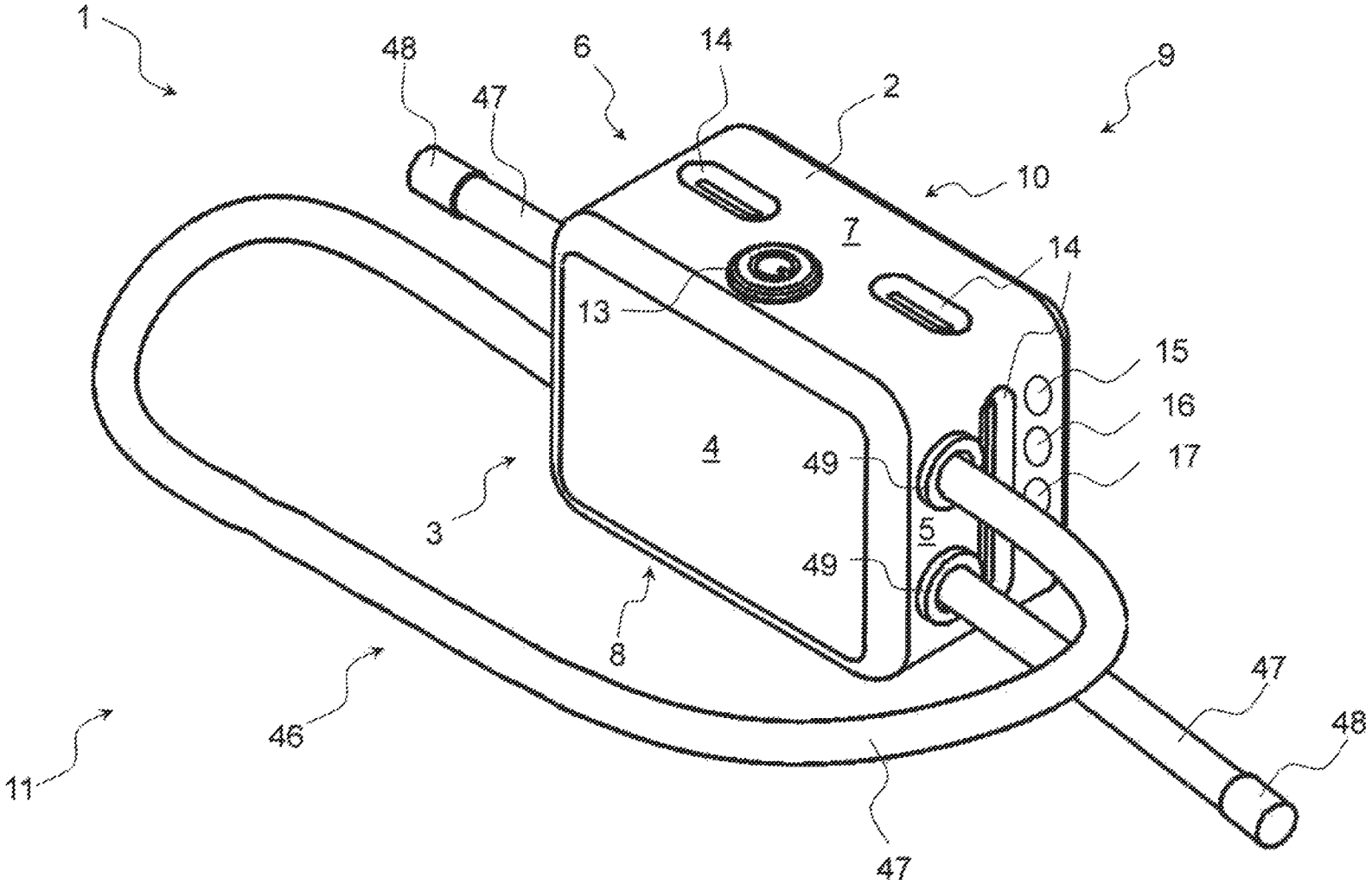

FIG. 8 shows a second embodiment of a device 1 in accordance with the invention in a schematic three-dimensional view. The descriptions provided for the first embodiment also apply to the second embodiment, unless expressly stated otherwise below.

In the second embodiment, an alternative or additional at least partially deformable wrap-around element is provided, which is formed as a steel cable 46 and an elastically deformable section 47, which is arranged between two end sections 48. Deformable wrap-around elements 46 are flexible in use, since their shape can be adjusted to the surface of the object to be protected.

Figure 9:
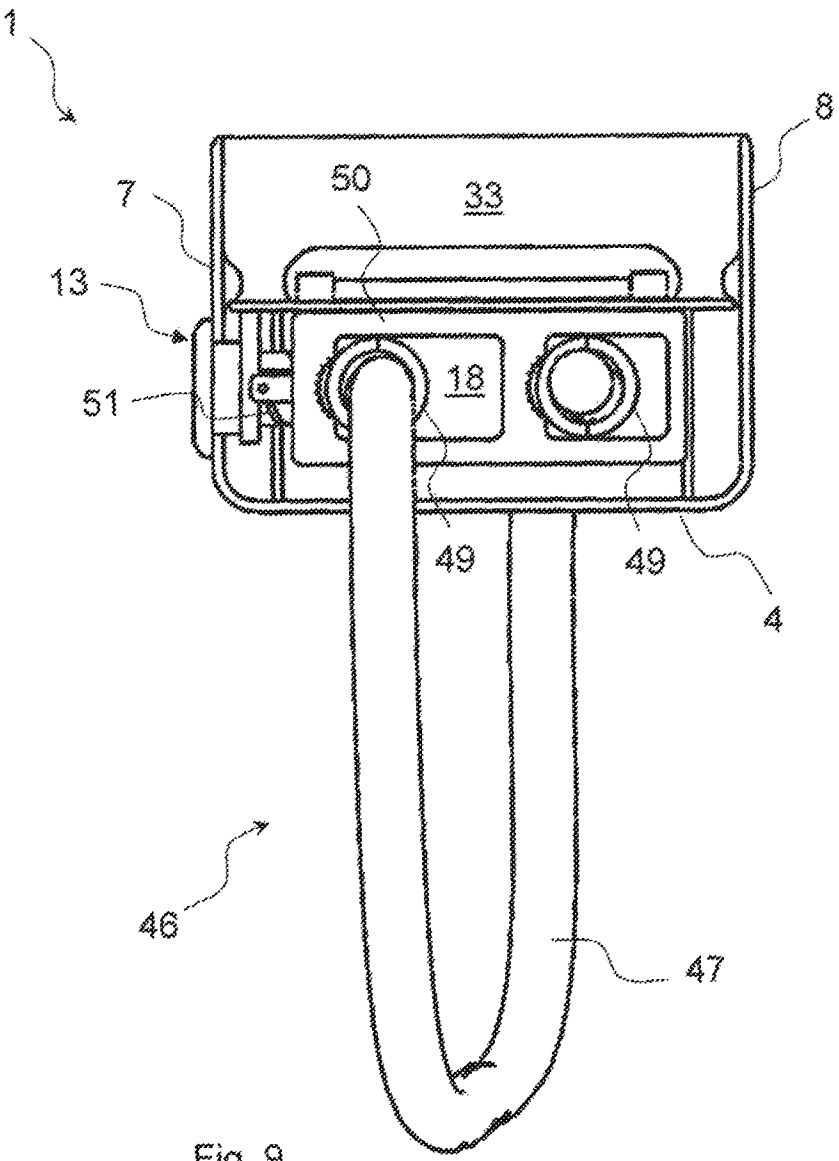

FIG. 9 shows the device of FIG. 8 in a schematic sectional side view, wherein the locking elements 49, 50, 51; 55, 57, 58 are open. The locking elements 49, 50, 51; 55, 57, 58 comprise two guide tubes 49 through which the steel cable 46 is guided in such a manner that a closed loop arises. Further, a clamping device 49, 50, 51 is provided for clamping the steel cable 46 in the guide tubes 49.

Figure 10:
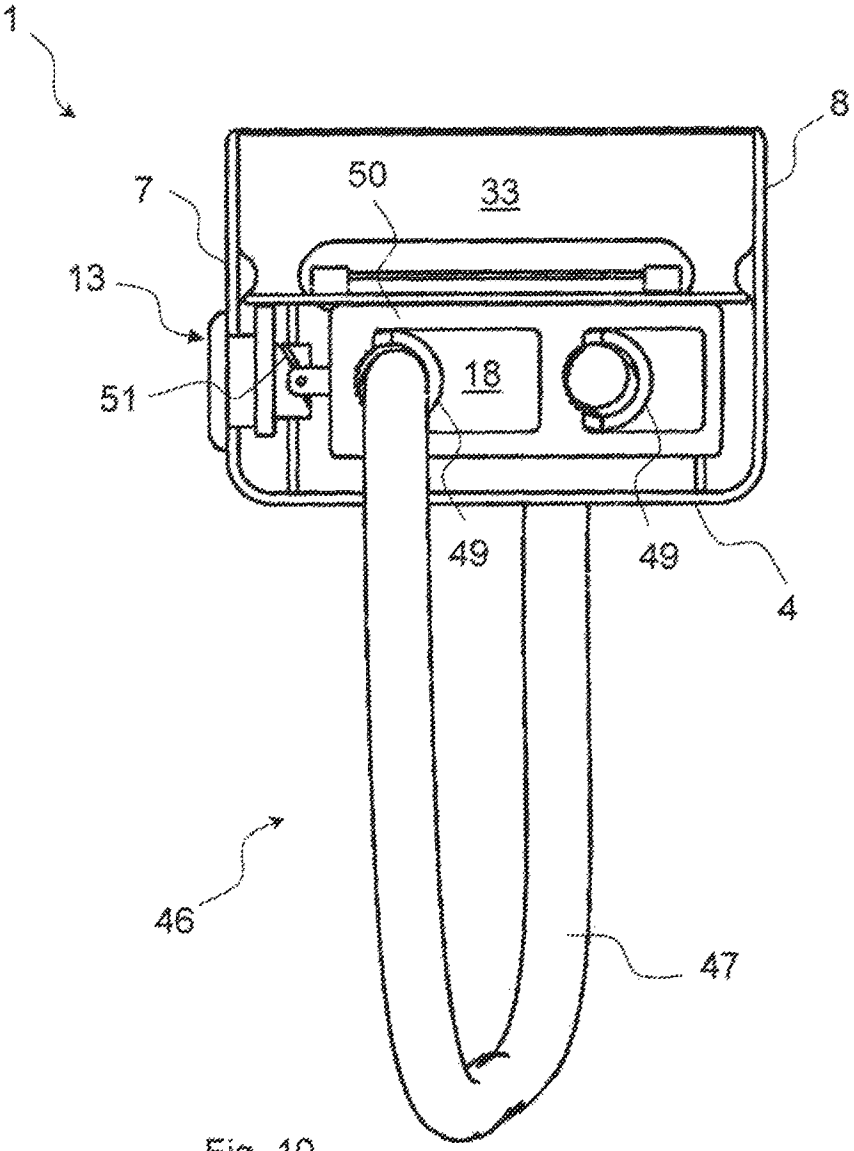

FIG. 10 shows the device of FIGS. 8 and 9 in a schematic sectional side view, wherein the locking elements 49, 50, 51; 55, 57, 58 are closed. The clamping device 49, 50, 51 comprises a clamping element 50, which preferably can be moved by means of a thread 51 rotatably connected to the lock device 13 from an open position shown in FIG. 9 to the clamping position shown in FIG. 10. In this manner, a frictional locking of the wrap-around elements 46 arises, which has the advantage that the wrap-around elements 46 can be locked with a freely selectable length, such that the length of the loop can be adjusted continuously. If the clamping device 49, 50, 51 can be selectively closed or opened by means of a thread 51 rotatably connected to the lock device 13, this results in a simple structure of the device 1 and the simple operability of the device 1.

Figure 11:
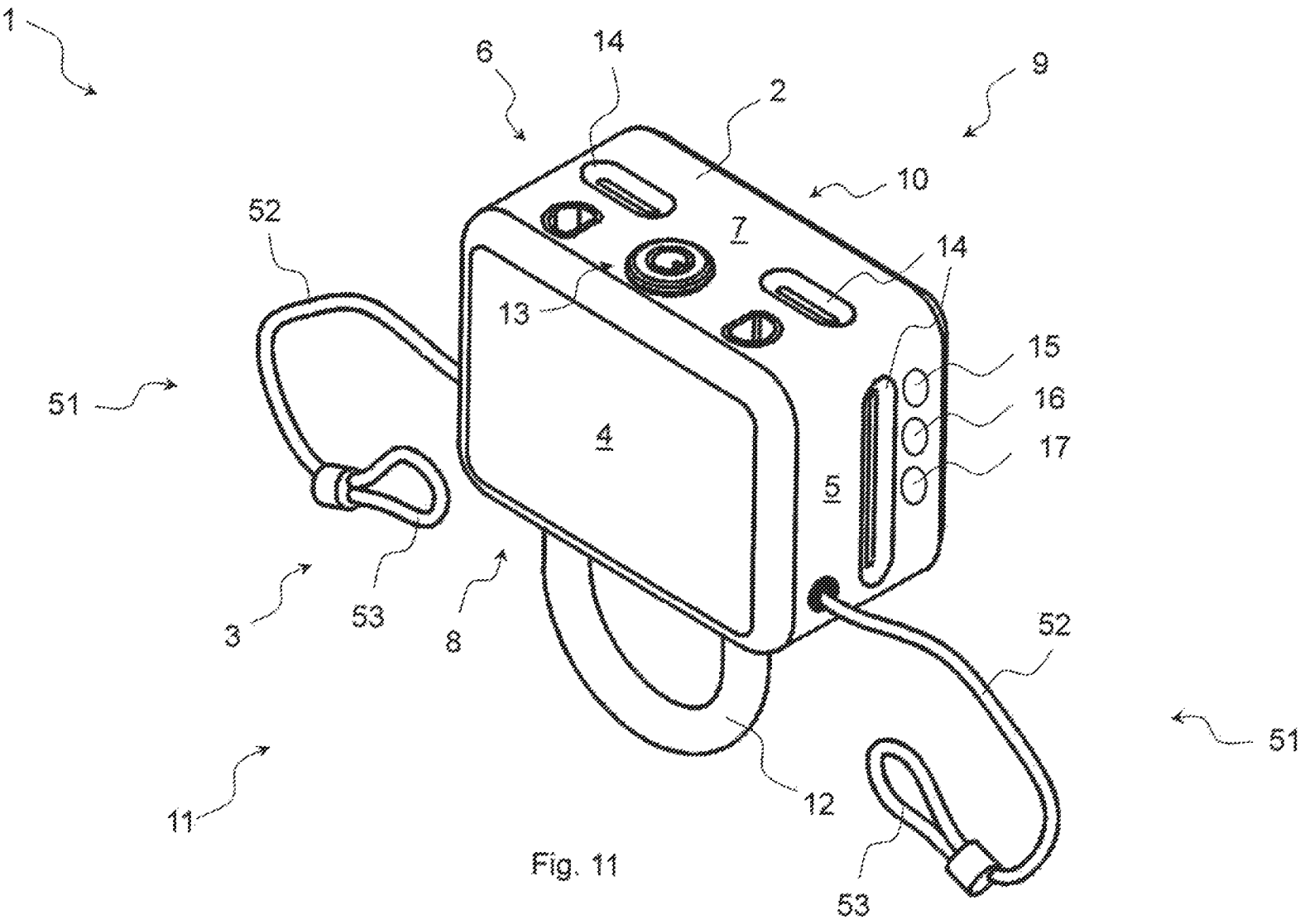

FIG. 11 shows a third embodiment of a device 1 in accordance with the invention in a schematic three-dimensional view, wherein the descriptions provided for the first and second embodiments also apply to the third embodiment, unless expressly stated otherwise below.

In the third embodiment, the wrap-around elements 12, 46 include, in addition to the bracket 12 already described, two eyelet cables 52, which are, for example, steel cables, and each of which features an elastically deformable section 53. In each case, one end of the eyelet cables can be fixed on the protective housing 2 by means of locking elements, while each free end features an eyelet 53 that is intended to be hooked into the bracket 12, such that the eyelet cables can form closed loops.

Figure 12:
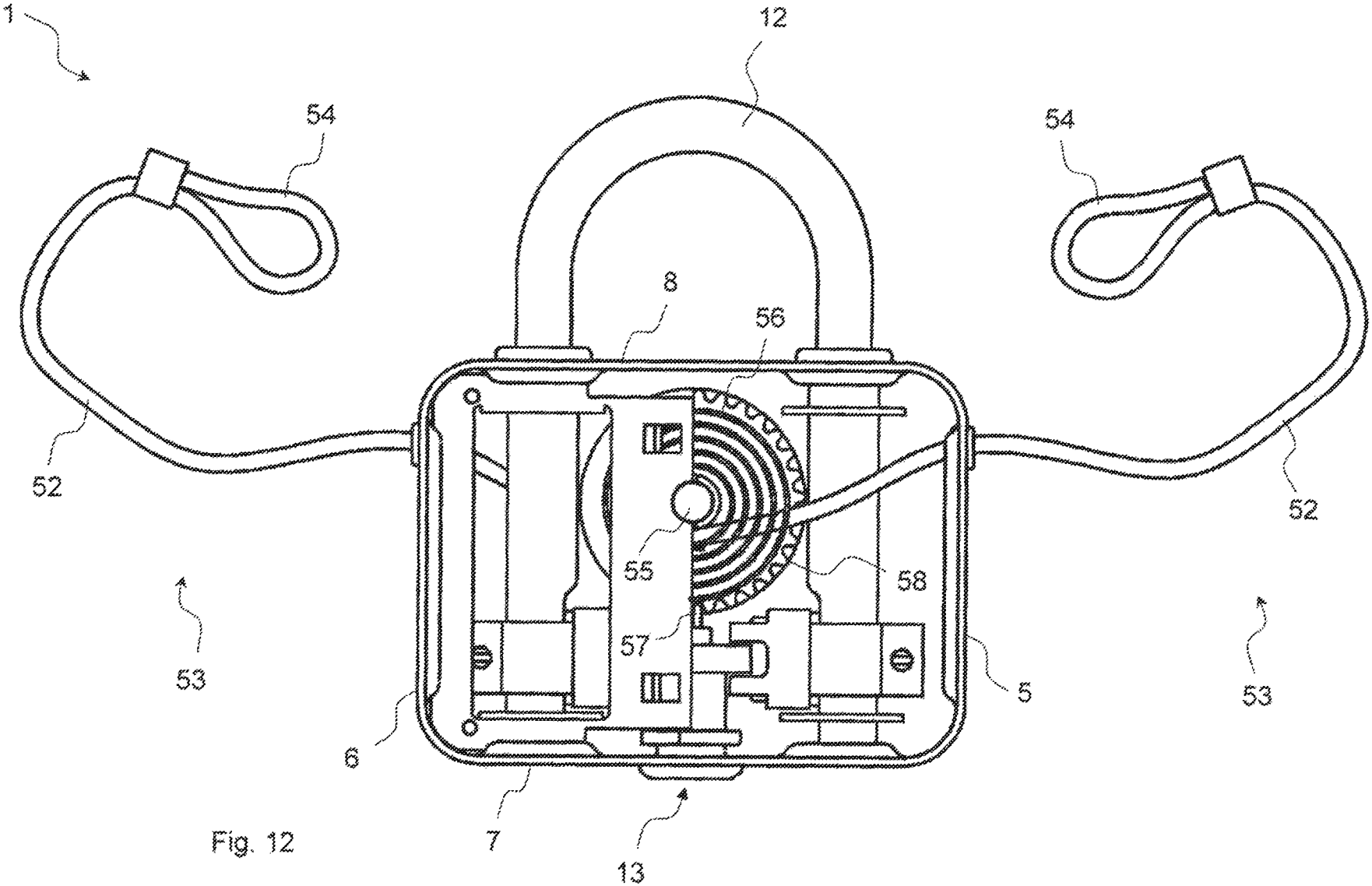

FIG. 12 shows the device of FIG. 9 in a schematic sectional top view, wherein the locking elements 55, 57, 58 are closed. Thereby, the locking elements 55, 57, 58 comprise rolling-up elements for rolling up the deformable wrap-around element 52. It is thereby possible to roll up the deformable wrap-around elements 52 if they are not needed. If the rolling-up elements 55 are spring-loaded by means of a spring 56, the deformable wrap-around elements 52 can be automatically rolled up. If, preferably, the rolling-up element 55 is selectively releasable or blockable by means of a blocking device 55, 57, 58 connected to the lock device 13 in respect of a rotation, the deformable wrap-around element 52 can be locked with selectable length, such that loops with varying lengths can be provided, such that the scope of application of the device 1 is further increased.

In the embodiment, the blocking device 55, 57, 58 features a latching element 57, which is movable by means of the mechanical lock 13'. Thereby, it can be brought into the position shown in FIG. 12, in which it engages in a teeth arrangement 58, which is connected in a torque-proof manner to the rolling-up elements 55, such that the wrap-around elements cannot be unwound from the rolling-up elements 55. In this manner, the wrap-around elements 52 are locked to the protective housing 2.

Figure 13:
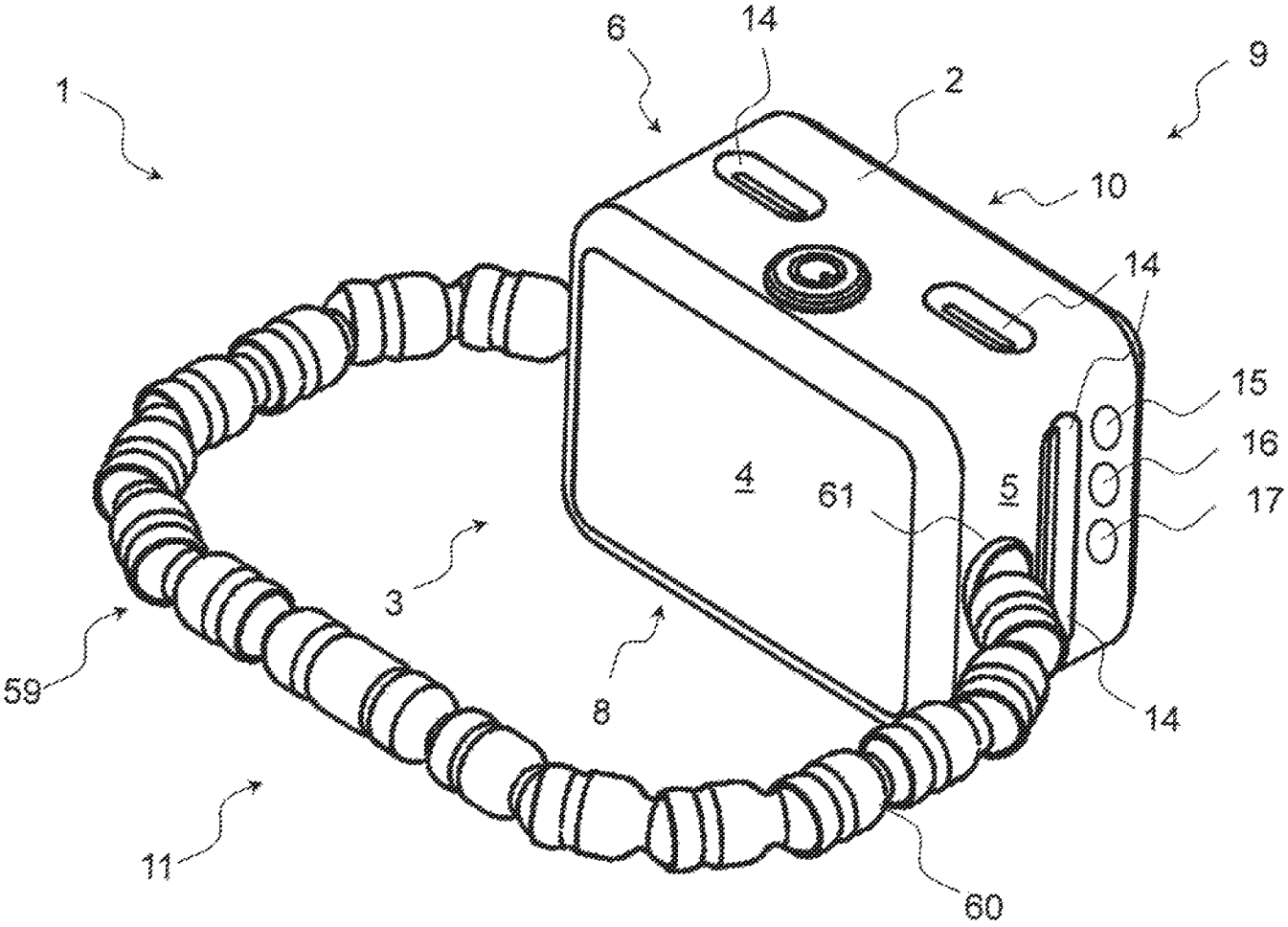

FIG. 13 shows a fourth embodiment of a device in accordance with the invention in a schematic three-dimensional view, wherein the descriptions provided for the preceding embodiments also apply to the fourth embodiment, unless expressly stated otherwise below.

In the fourth embodiment, an alternative or additional at least partially deformable wrap-around element is provided, which is formed as a link chain 59 and a flexibly deformable section 60.

Figure 14:
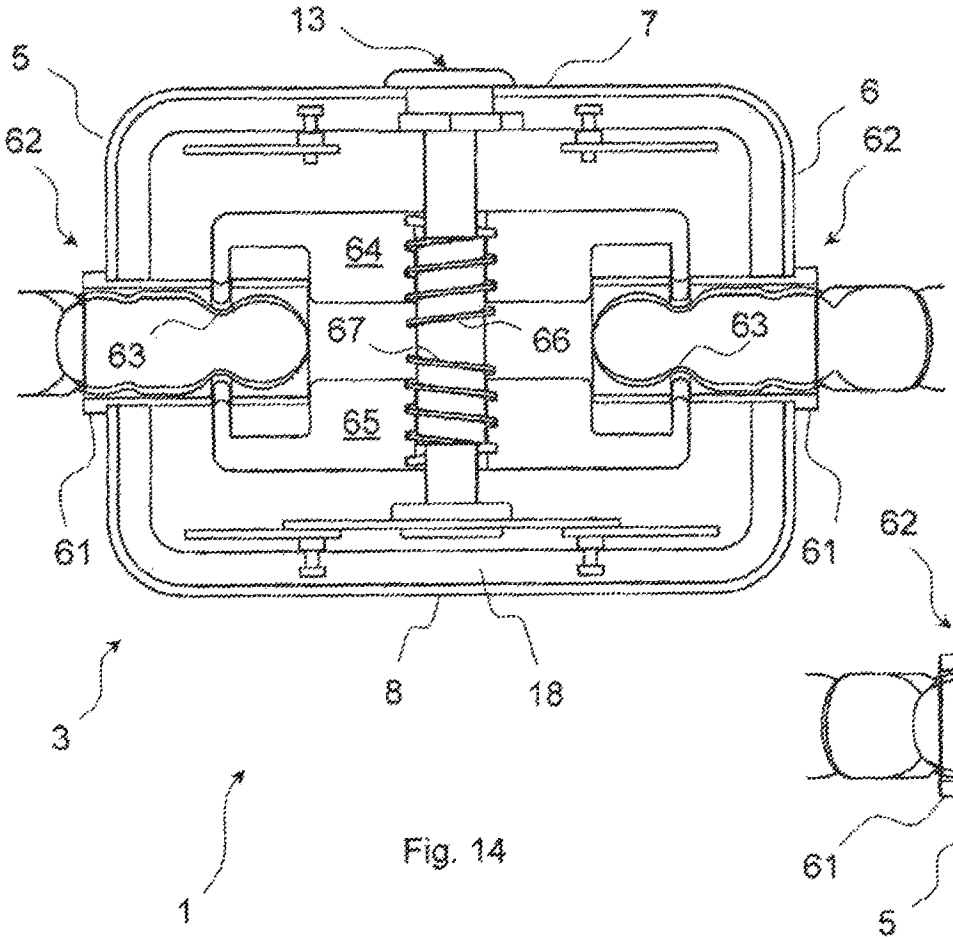

FIG. 14 shows the device of FIG. 13 in a schematic sectional top view, wherein the locking elements 61, 63, 64, 65 are open. The locking elements 61, 63, 64, 65 comprise two guide tubes 61, into which the end sections 62 of the link chain 59 are guided in such a manner in that a closed loop is formed. Each of the end sections 62 of the link chain 59 features a ring-shaped undercut 63. The locking elements 61, 63, 64, 65 further comprise a first latching element 64 and a second latching element 65, wherein the first latching element 64 is movable by means of a first thread 66 and the second latching element 65 is movable by means of a second thread 67. Thereby, the threads 66 and 67 are rotatable by means of the mechanical lock 13'. If the mechanical lock 13' is rotated, the latching elements 64 and 65 leave the open positions shown in FIG. 14.

Figure 15:
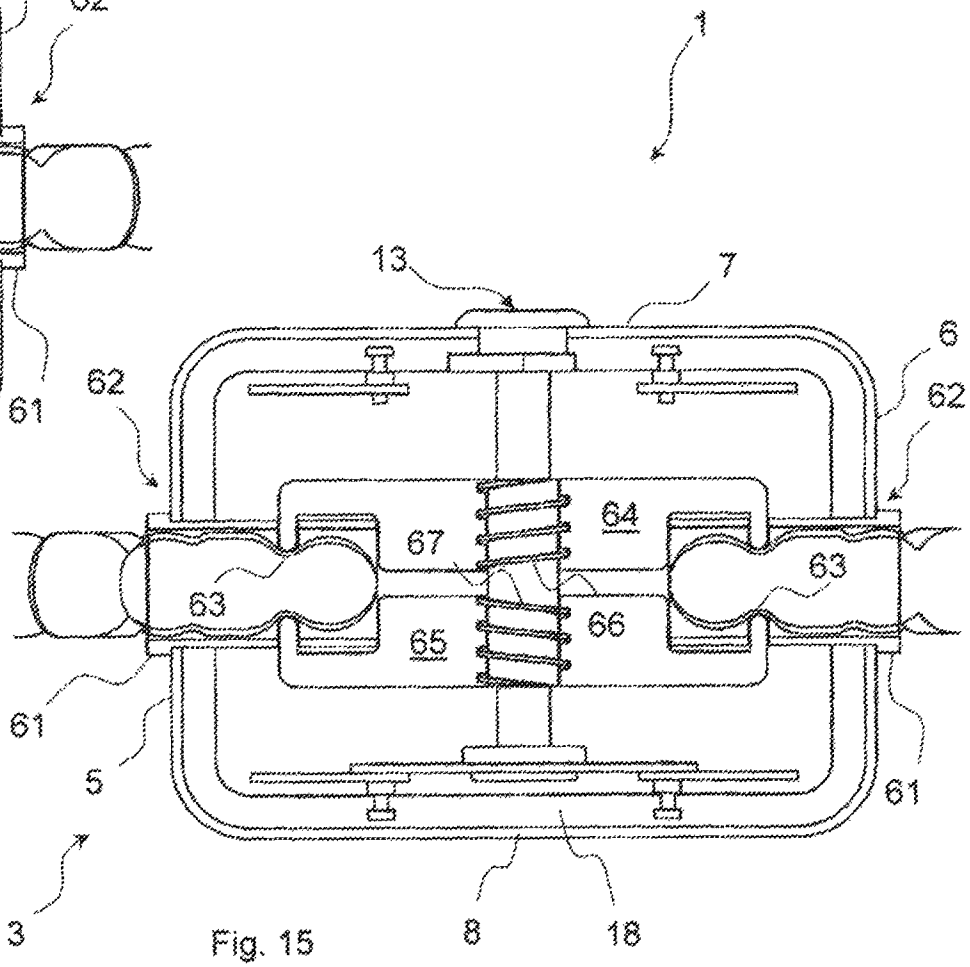

FIG. 15 shows the device of FIGS. 13 and 14, in a schematic sectional top view, wherein the locking elements 61, 63, 64, 65 are closed. Thereby, the first latching element 64 engages the ring-shaped undercuts 63 from one side, and the second latching element 65 engages the ring-shaped undercuts 63 from the other side, such that the link chain 59 is locked on the protective housing 2 on both sides.

Figure 16:
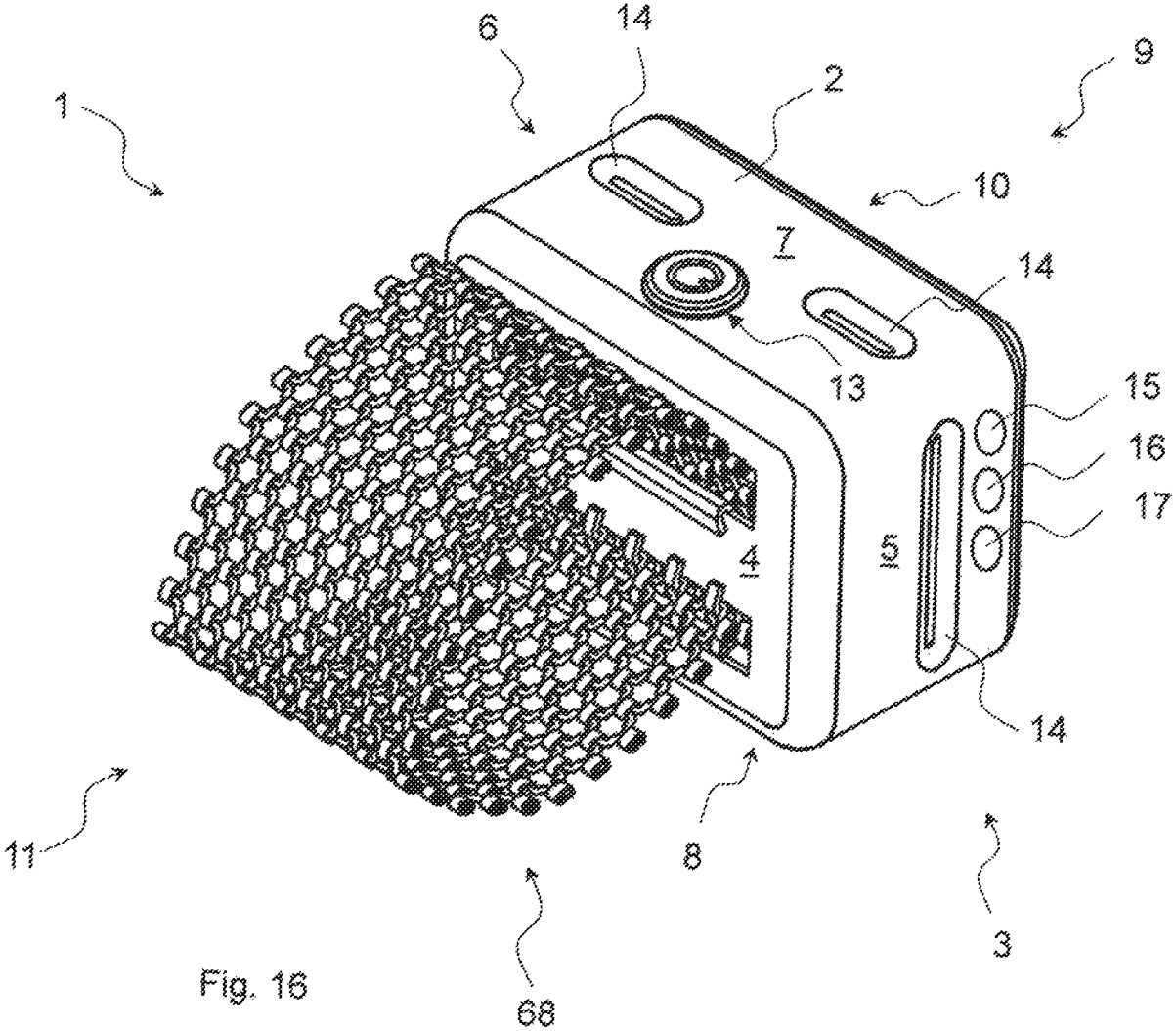

FIG. 16 shows a fifth embodiment of a device in accordance with the invention in a schematic three-dimensional view, wherein the descriptions provided for the preceding embodiments also apply to the fifth embodiment, unless expressly stated otherwise below.

In the fifth embodiment, an alternative or additional at least partially deformable wrap-around element 68 is provided, which is formed as a chain belt 68 and features a flexibly deformable section.

Figure 17:
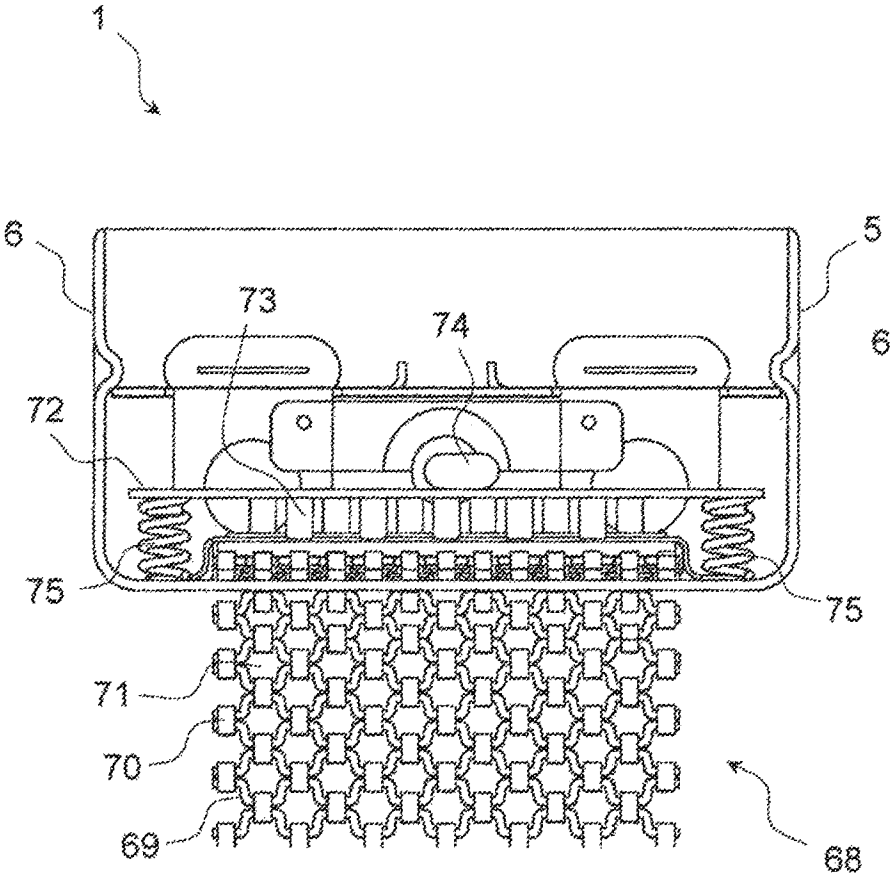

FIG. 17 shows the device of FIG. 16 in a schematic sectional side view, wherein the locking elements 71, 72, 73 are open. The chain belt 68 comprises a multitude of transverse connecting elements 69 and a multitude of longitudinal connecting elements 70 along with a multitude of openings 71 arranged between them. The locking elements 71, 72, 73 comprise a latching element carrier 72 at which a multitude of latching elements 73 is arranged. By means of a closing cam 74, which is connected in a torque-proof manner to the mechanical lock 13', the latching element carrier 72 may move in such a manner that the latching elements 73 engage in openings 71 of the chain belt 68, in order to lock it. Thereby, springs 75 are provided, which impinge on the latching element carrier 72 in such a manner that, with an ineffective closing cam 74, it is pressed into an open position shown in FIG. 17, at which the latching elements 73 do not engage in openings 71 of the chain belt 68.

Figure 18:
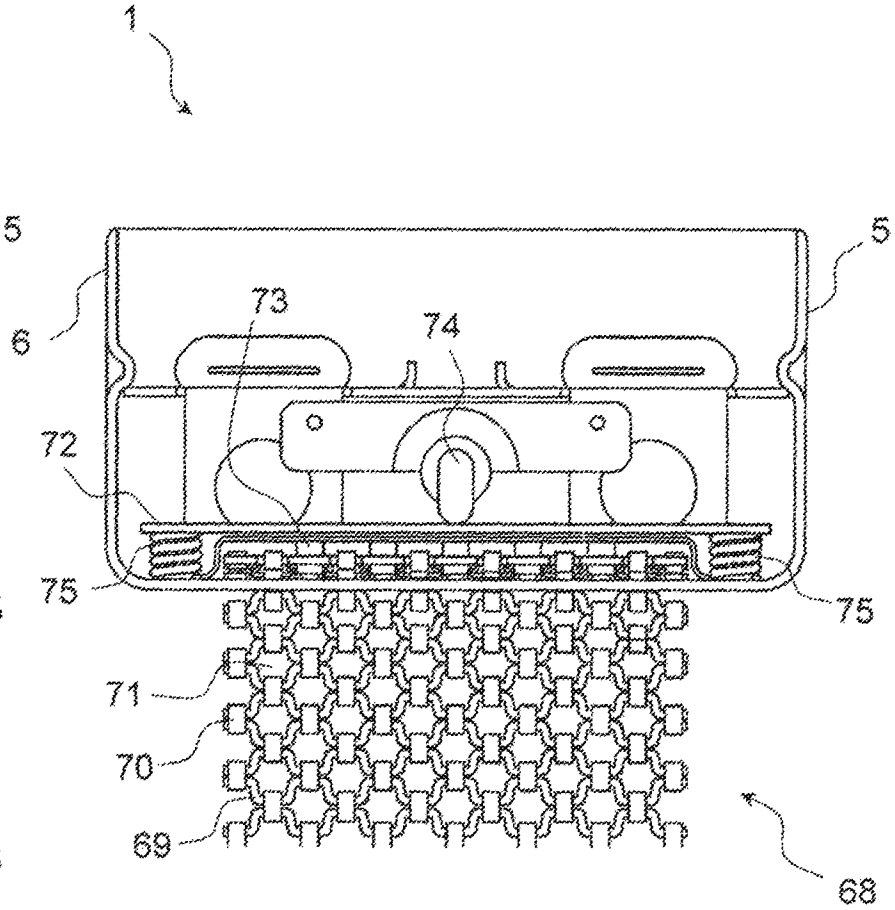

FIG. 18 shows the device of FIGS. 16 and 17 in a schematic sectional side view, wherein the locking elements 71, 72, 73 are closed.

Figure 19:
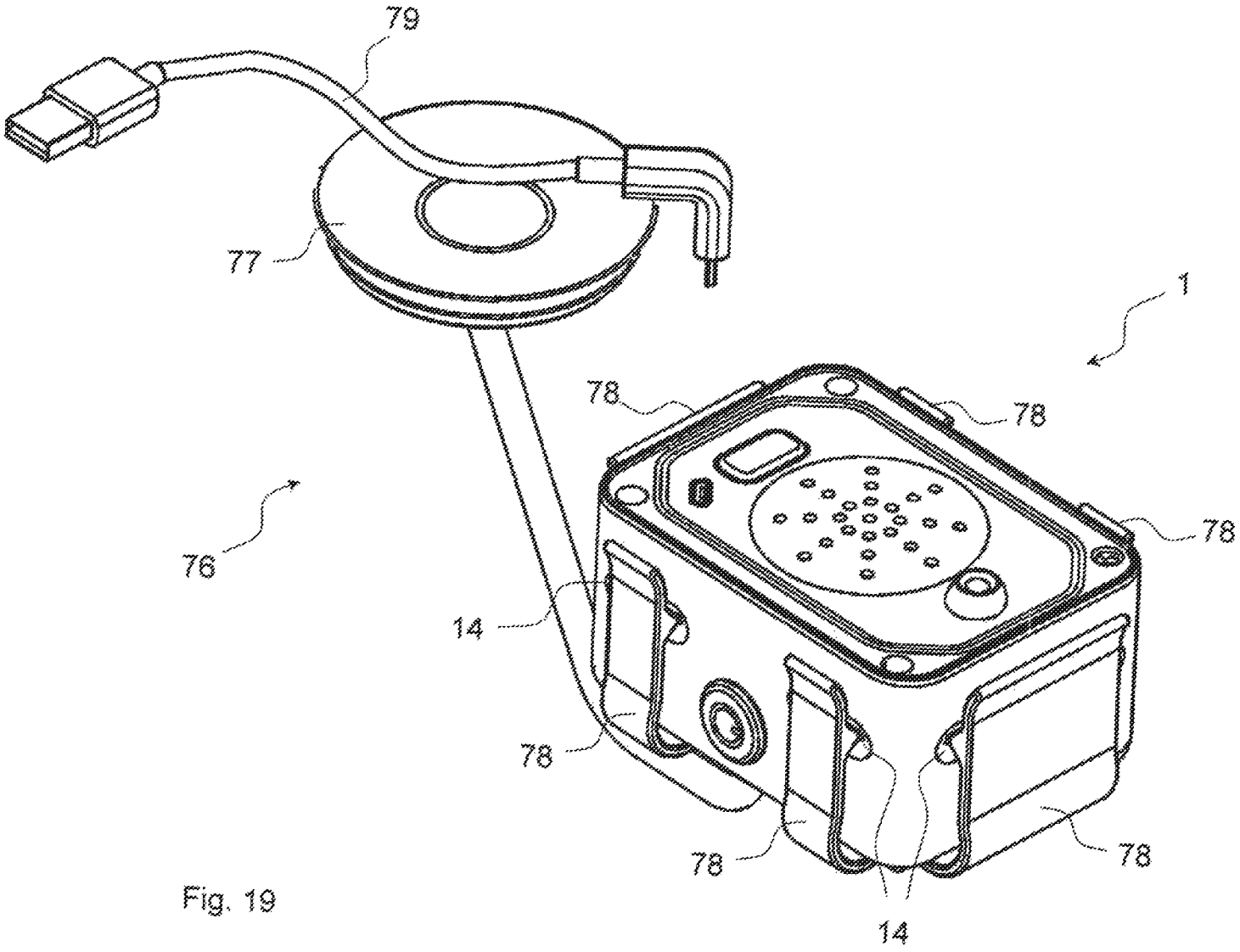

FIG. 19 shows an embodiment of a set in accordance with the invention in a schematic three-dimensional view. The set 1, 76, 79 features a transportable device 1 for preventing the loss of a movable object and a vehicle mount 76 for detachably mounting the device 1 on a vehicle, wherein the transportable device 1 is formed in accordance with the invention. The vehicle mount 76 is particularly advantageous if the device 1 is operated in emergency mode.

Preferably, the vehicle mount 76 features a clamping device or a suction foot 77 for securing the vehicle mount on the vehicle. In this manner, the vehicle mount 76 can be easily and securely fastened on almost any vehicle.

Expediently, a power supply cable and/or a data cable 79 is provided. Thereby, on the one hand, power can be transferred from the electrical system of the motor vehicle to the device 1 and, on the other hand, a data exchange between the vehicle and the device 1 can also be enabled. For example, the position data of the positioning device 37*a* of the device 1 can be adjusted with the position data of a positioning device of the vehicle.

Modifications and variations can be made to the embodiments illustrated or described herein without departing from the scope and spirit of the invention as set forth in the appended claims.

LIST OF REFERENCE SIGNS

1 Transportable device
2 Protective housing
3 First housing part
4 Bottom
5 First side wall
6 Second side wall
7 Front wall
8 Rear wall
9 Second housing part
10 Cover
11 Fastening element
12 Wrap-around element
13 Lock device
13' Mechanical lock
13" Electronically activated element
14 Mounting section
15 First LED
16 Second LED
17 Third LED
18 First chamber
19 Guide tubes for the bracket
20 Undercut
21 Latching element
22 Spring
23 Closing cam
24 First lever
25 Second lever
26 Third lever
27 First latch
28 Second latch

29 First opening
30 Second opening
31 Locking cam
32 Unlocking spring
33 Second chamber
34 Partition wall assembly
35 Electronic alarm device
36 Tilt sensor
37 Emergency button
37*a* Positioning device
38 Mobile telephone device
39 Acoustic alarm transmitter
40 Camera
41 Acceleration sensor
41*a* Direction-finding transmitter
42 First electrical energy storage device
43 Second electrical energy storage device
44 Power supply connection and/or data connection
45 Electronic lock
46 Steel cable
47 Deformable section
48 End section
49 Guide tube for the steel cable
50 Clamping element
51 Thread
52 Eyelet cable
53 Deformable section
54 Eyelet
55 Rolling-up element
56 Spring
57 Latching element
58 Teeth arrangement
59 Link chain
60 Deformable section
61 Guide tube for the link chain
62 End section
63 Undercut
64 First latching element
65 Second latching element
66 First thread
67 Second thread
68 Chain belt
69 Transverse connecting element
70 Longitudinal connecting element
71 Opening
72 Latching element carrier
73 Latching element
74 Closing cam
75 Spring
76 Vehicle mount
77 Suction foot
78 Mounting element
79 Power supply connection and/or data connection

What is claimed is:

1. A transportable device, comprising:

a protective housing;

a fastening element selectively fixable to the protective housing such that the protective housing is optionally attachable to a part of a movable object;

an electronic alarm device configured to be selectively fixable relative to the protective housing;

a lock device rigidly connected to the protective housing, the lock device being configured to selectively fix the electronic alarm device relative to the protective housing;

wherein the electronic alarm device is operationally and structurally isolated from the fastening element such that destruction of the fastening element does not disable or trigger the electronic alarm device, wherein the electronic alarm device is operable in a stand-alone mode when the electronic alarm device is removed from the protective housing.

2. The transportable device according to claim 1, wherein the lock device comprises a mechanical lock that is actuated via a mechanical key.

3. The transportable device according to claim 1, wherein the lock device comprises a mechanical component and an electrically actuated element configured to actuate the mechanical component, the operation of the electrically actuated element being controllable via an electronic signal.

4. The transportable device according to claim 1, wherein the lock device is configured to selectively fix the fastening element to the protective housing.

5. The transportable device according to claim 1, wherein the fastening element comprises one of a rigid, dimensionally stable wrap-around element, or a deformable wrap-around element.

6. The transportable device according to claim 1, wherein the electronic alarm device comprises any one or combination of:

an acoustic alarm transmitter that outputs an acoustic alarm message;

a visual display device that displays operating states of the alarm device;

a direction-finding transmitter that sends direction determination signals; or a water-protected power supply within the protective housing.

7. The transportable device according to claim 1, wherein the electronic alarm device comprises a motion sensor, wherein, when the electronic alarm device is activated, the electronic alarm device generates an alarm message upon sensed motion.

8. The transportable device according to claim 1, wherein the electronic alarm device comprises a position sensing device, wherein, when the electronic alarm device is activated, the electronic alarm device generates an alarm message upon a change of position of the device.

9. The transportable device according to claim 1, wherein the electronic alarm device comprises a communications device that generates and transmits an alarm message to a receiver.

10. The transportable device according to claim 9, wherein an emergency mode of the electronic alarm device is activatable in which the communications device automatically generates and transmits an emergency message to the receiver that includes a position of the device.

11. The transportable device according to claim 10, wherein the electronic alarm device comprises a motion sensor, wherein, when the emergency mode of the electronic alarm is activated, upon detection by the motion sensor of a sensed acceleration exceeding a predetermined limit, the communications device automatically generates and transmits the emergency message.

12. The transportable device according to claim 10, wherein the electronic alarm device comprises a position sensing device, wherein, when the emergency mode of the electronic alarm device is activated, upon detection by the position sensing device of a constant position for a predetermined time, the communications device automatically generates and transmits the emergency message.

13. The transportable device according to claim 9, wherein the electronic alarm device comprises an emergency button, wherein an emergency mode is activatable by actuation of the emergency button in which the communications device generates and transmits an emergency message to the receiver that includes a position of the device.

14. The transportable device according to claim 13, wherein the electronic alarm device comprises a motion sensor, wherein, when the electronic alarm device is activated via the emergency button, the communications device generates and transmits the emergency message upon detection by the motion sensor of a sensed acceleration exceeding a predetermined limit.

15. The transportable device according to claim 13, wherein the electronic alarm device comprises a position sensing device, wherein, when the electronic alarm device is activated via the emergency button, the communications device generates and transmits the emergency message upon detection by the position sensing device of a constant position for a predetermined time.

16. The transportable device according to claim 1, wherein the electronic alarm device comprises a transmitter and a receiver for a two-way communication functionality.

17. The transportable device according to claim 16, wherein the receiver is configured to receive a signal for activating or deactivating the electronic alarm device, the receiver being configured to receive the signal for activating or deactivating the electronic alarm device when the electronic alarm device is fixed relative to the protective housing, and the receiver being configured to receive the signal for activating or deactivating the electronic alarm device when the electronic alarm device is removed from the protective housing.

18. The transportable device according to claim 1, wherein the electronic alarm device comprises an emergency mode that automatically detects an occurrence of an emergency.

19. The transportable device according to claim 1, wherein the electronic alarm device comprises a camera.

20. The transportable device according to claim 1, wherein the electronic alarm device is triggerable when the electronic alarm device is fixed relative to the protective housing, and wherein the electronic alarm device is triggerable in the stand-alone mode when the electronic alarm device is removed from the protective housing.

* * * * *